US012228346B2

(12) United States Patent
Hikone

(10) Patent No.: US 12,228,346 B2
(45) Date of Patent: Feb. 18, 2025

(54) CHILLING UNIT

(71) Applicant: Mitsubishi Electric Corporation, Tokyo (JP)

(72) Inventor: Takahito Hikone, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 579 days.

(21) Appl. No.: 17/610,597

(22) PCT Filed: Aug. 7, 2019

(86) PCT No.: PCT/JP2019/031080
§ 371 (c)(1),
(2) Date: Nov. 11, 2021

(87) PCT Pub. No.: WO2021/024403
PCT Pub. Date: Feb. 11, 2021

(65) Prior Publication Data
US 2022/0221228 A1 Jul. 14, 2022

(51) Int. Cl.
*F28D 7/16* (2006.01)
*F28F 1/04* (2006.01)

(52) U.S. Cl.
CPC ..... *F28D 7/1653* (2013.01); *F28F 1/04* (2013.01)

(58) Field of Classification Search
CPC ..... F28D 7/1653; F28D 1/0443; F28D 2021/0068; F28F 1/04; F24F 1/68;
(Continued)

(56) References Cited

U.S. PATENT DOCUMENTS 3,026,092 A * 3/1962 Pellegrini ..... F28F 9/0273 165/157
5,267,610 A * 12/1993 Culbert ..... F28F 1/32 29/890.047

(Continued)

FOREIGN PATENT DOCUMENTS

EP 3 287 706 A1 2/2018
EP 3441685 A4 * 5/2019 ..... F24F 1/10

(Continued)

OTHER PUBLICATIONS

International Search Report of the International Searching Authority mailed Oct. 8, 2019 for the corresponding international application No. PCT/JP2019/031080 (and English translation).

(Continued)

*Primary Examiner* — Len Tran
*Assistant Examiner* — Gustavo A Hincapie Serna
(74) *Attorney, Agent, or Firm* — Posz Law Group, PLC

(57) ABSTRACT

A chilling unit includes: air heat exchangers each including heat transfer tubes and fins; and a machine room unit on which the air heat exchangers are provided. The air heat exchangers each have a long-side portion that extends in a longitudinal direction of the machine room unit. The air heat exchangers includes a pair of air heat exchangers that are inclined such that a spacing between upper end portions of the heat exchangers is greater than a spacing between lower end portions thereof. In each pair, the long-side portion of at least one air heat exchanger has a heat-exchanger end portion located at a unit end portion of the machine room unit in the longitudinal direction, and from the heat-exchanger end portion, heat transfer tubes that protrudes from an outermost one of the fins in an arrangement direction thereof and that extend linearly in the lateral direction do not extend.

12 Claims, 10 Drawing Sheets

(58) Field of Classification Search
CPC ..... F24F 1/16; F24F 1/50; F25B 39/04; F25B 39/02; F25B 13/00; F25B 2313/003; F25B 2400/06; F25B 2400/075
USPC ..... 165/173
See application file for complete search history.

(56) References Cited

U.S. PATENT DOCUMENTS

| | | | | |
|---|---|---|---|---|
| 9,127,867 | B2 | 9/2015 | Tanno et al. | |
| 9,869,487 | B2 * | 1/2018 | Nickey | F28B 1/06 |
| 10,072,883 | B2 | 9/2018 | Tanno et al. | |
| 10,267,534 | B2 * | 4/2019 | Fukui | F24F 13/30 |
| 10,619,901 | B2 * | 4/2020 | Mast | F28F 1/022 |
| 10,801,783 | B2 * | 10/2020 | Jin | F28D 1/05325 |
| 11,280,341 | B2 * | 3/2022 | Bauduin | F28D 1/0477 |
| 2003/0106677 | A1 * | 6/2003 | Memory | F28D 1/0478 165/135 |
| 2010/0162739 | A1 * | 7/2010 | Kopko | F24F 1/50 62/115 |
| 2012/0125033 | A1 * | 5/2012 | Tanno | F25B 30/02 165/181 |
| 2013/0333409 | A1 * | 12/2013 | Tanno | F24F 1/06 62/324.1 |
| 2014/0262147 | A1 * | 9/2014 | Pawlick | F28D 1/024 165/67 |
| 2017/0130974 | A1 * | 5/2017 | Mercer | F24F 1/56 |
| 2017/0205085 | A1 * | 7/2017 | Lu | F28F 1/02 |
| 2018/0080667 | A1 * | 3/2018 | Nishimoto | F24F 1/16 |
| 2018/0283814 | A1 * | 10/2018 | Najafifard | F28B 1/02 |
| 2019/0137183 | A1 * | 5/2019 | Byrne | F28B 1/06 |
| 2020/0011605 | A1 * | 1/2020 | Endo | F28F 1/32 |
| 2020/0378694 | A1 * | 12/2020 | Chehade | F28F 9/266 |
| 2021/0123650 | A1 * | 4/2021 | Mukaitani | F24F 11/30 |
| 2021/0254897 | A1 * | 8/2021 | Matsumoto | F28D 1/0435 |
| 2022/0011010 | A1 * | 1/2022 | Silva | F24F 13/029 |
| 2022/0018553 | A1 * | 1/2022 | Akaiwa | F24F 1/0068 |
| 2022/0221227 | A1 * | 7/2022 | Wagner | F28F 1/32 |

FOREIGN PATENT DOCUMENTS

| | | | | |
|---|---|---|---|---|
| GB | 2577431 | A * | 3/2020 | F24F 1/18 |
| JP | 5555701 | B2 | 7/2014 | |
| JP | 5760049 | B2 | 8/2015 | |
| JP | 2017-537287 | A | 12/2017 | |
| JP | 2019-124374 | A | 7/2019 | |
| WO | 2017/ 010210 | A1 | 1/2017 | |
| WO | WO-2018180253 | A1 * | 10/2018 | F24F 1/22 |
| WO | 2019/012619 | A1 | 1/2019 | |

OTHER PUBLICATIONS

Extended European Search Report dated Jul. 7, 2022 issued in corresponding European patent application No. 19940470.8.
Office Action dated Aug. 2, 2022 issued in corresponding JP patent application No. 2021-538607 (and English translation).
Office Action dated Nov. 11, 2024 issued for the corresponding European Patent Application No. 19940470.8.

* cited by examiner

Comparative Example

CHILLING UNIT

CROSS REFERENCE TO RELATED APPLICATION

This application is a U.S. national stage application of PCT/JP2019/031080 filed on Aug. 7, 2019, the contents of which are incorporated herein by reference.

TECHNICAL FIELD

The present disclosure relates to a chilling unit that forms, for example, an air-conditioning apparatus, a heat-pump water heater, or a refrigeration apparatus.

BACKGROUND ART

In the past, chilling units have been proposed each of which includes a heat exchange unit that houses an air heat exchanger and a fan and a machine room that houses a compressor and a heat exchanger (see, for example, Patent Literature 1).

CITATION LIST

Patent Literature

Patent Literature 1: Japanese Patent No. 5760049

SUMMARY OF INVENTION

Technical Problem

In the case of performing maintenance on a chilling unit having an elongated shape, a worker enters a heat exchange portion of the chilling unit from an end face thereof that corresponds to a front side of the chilling unit in a longitudinal direction thereof. However, the chilling unit described in Patent Literature 1 has an L-shaped bent portion at its end portion in the longitudinal direction, and heat transfer tubes of a pair of air heat exchangers disposed in the lateral direction extend on the front side of the chilling unit. Therefore, in the chilling unit described in Patent Literature 1, two systems of header pipes or distributors associated with a pair of air heat exchangers are disposed at part of the chilling unit through which the worker enters the front side of the chilling unit. Thus, the worker does not easily enter or leave the heat exchange portion, and thus does not easily perform maintenance on the chilling unit.

The present disclosure is applied to solve the above problem, and relates to a chilling unit that allows a worker to easily enter and exit a space defined by air heat exchangers, whereby the ease of maintenance of a heat exchange portion of the chilling unit is improved.

Solution to Problem

A chilling unit according to an embodiment of the present disclosure includes: a plurality of air heat exchangers each including a plurality of heat transfer tubes and a plurality of fins; and a machine room unit which is formed in the shape of an elongated box and on which the plurality of air heat exchangers are provided. The plurality of air heat exchangers each have a long-side portion that extends in a longitudinal direction of the machine room unit. The plurality of air heat exchangers include two pairs of air heat exchangers, the pairs of air heat exchangers are arranged side by side in the longitudinal direction, and the air heat exchangers of each of the pairs of air heat exchangers are opposite to each other in a lateral direction of the machine room unit. The air heat exchangers of each pair are inclined such that a spacing between upper end portions of the air heat exchangers that are located far from the machine room unit is greater than a spacing between lower end portions of the air heat exchangers that are located close to the machine room unit. In each pair, the long-side portion of at least one of the air heat exchangers has a heat-exchanger end portion that is located at one of unit end portions of the machine room unit in the longitudinal direction, and from the heat-exchanger end portion of the long-side portion of the at least one of the air heat exchangers, heat transfer tubes that protrude from an outermost one of the plurality of fins in a direction in which the plurality of fins are arranged and that extend linearly in the lateral direction do not extend.

Advantageous Effects of Invention

According to an embodiment of the present disclosure, in the chilling unit, the heat-exchanger end portion of the long-side portion of at least one air heat exchanger of a pair of air heat exchangers is provided at one of the unit end portions of the machine room unit in the longitudinal direction (X-axis direction). From the heat-exchanger end portion, heat transfer tubes that protrude from an outermost one of the fins in the direction where the fins are arranged and that extend linearly in the lateral direction (Y-axis direction) do not extend. Therefore, in the chilling unit, the heat transfer tubes of at least one of a pair of air heat exchangers provided in the lateral direction do not extend to cover the front side of the chilling unit. Thus, in the chilling unit, not both two systems of header pipes or not both distributors at a pair of air heat exchangers are disposed on the front side of the chilling unit where the worker enters the chilling unit. It is therefore possible to provide a sufficient space for the worker to enter the chilling unit on the front side of the chilling unit. The worker is thus able to easily enter and exit a space defined by air exchangers and corresponding to the heat exchange part of the chilling unit. The ease of maintenance of the chilling unit is improved.

DESCRIPTION OF EMBODIMENTS

A chilling unit 100 according to each of embodiments will be described with reference to the drawings or other illustrations. In figures including FIG. 1 that will be referred to below, the relative dimensions, shapes, and other features of various components may differ from actual ones. In each of the figures, components that are the same as or equivalent to a previous figure or previous figures are denoted by the same reference sings, and the same is true of the entire text of the specification. With respect to the embodiments, in order that they be easily understood, terms related to directions (such as "upper", "lower", "right", "left", front", and "rear") are used as appropriate. However, these terms are used only for explanation, that is, they do not limit the locations or orientations of devices or components.

Embodiment 1

[Chilling Unit 100]

Figure 1:
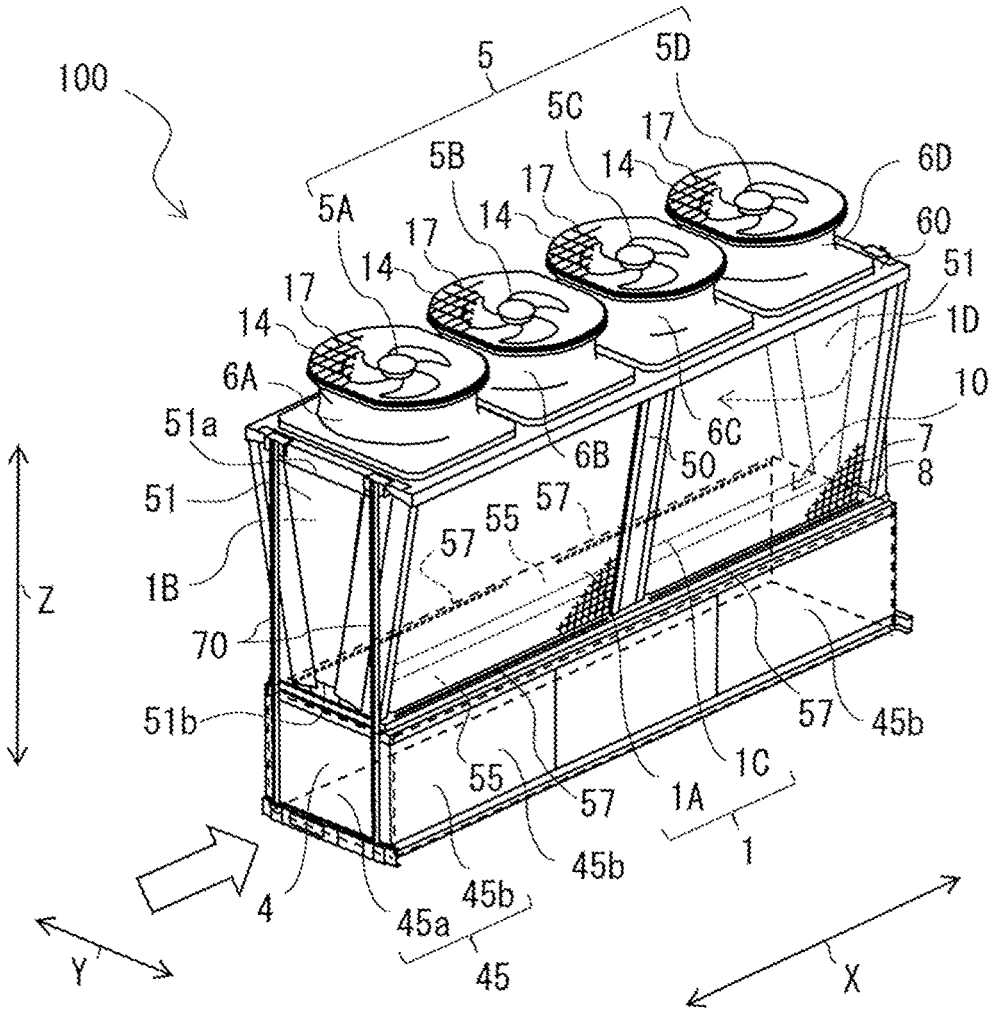
FIG. 1 is a perspective view of a chilling unit according to Embodiment 1.
Figure 2:
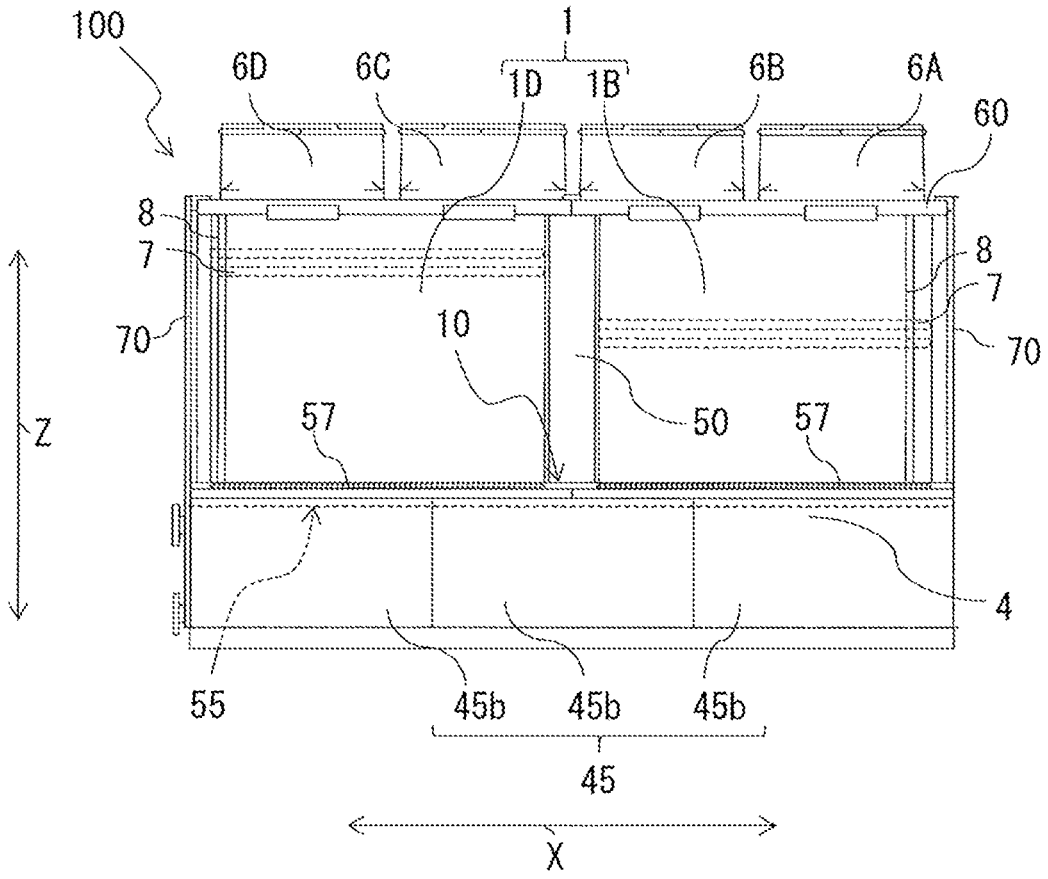
FIG. 2 is a side view of the chilling unit according to Embodiment 1.
Figure 3:
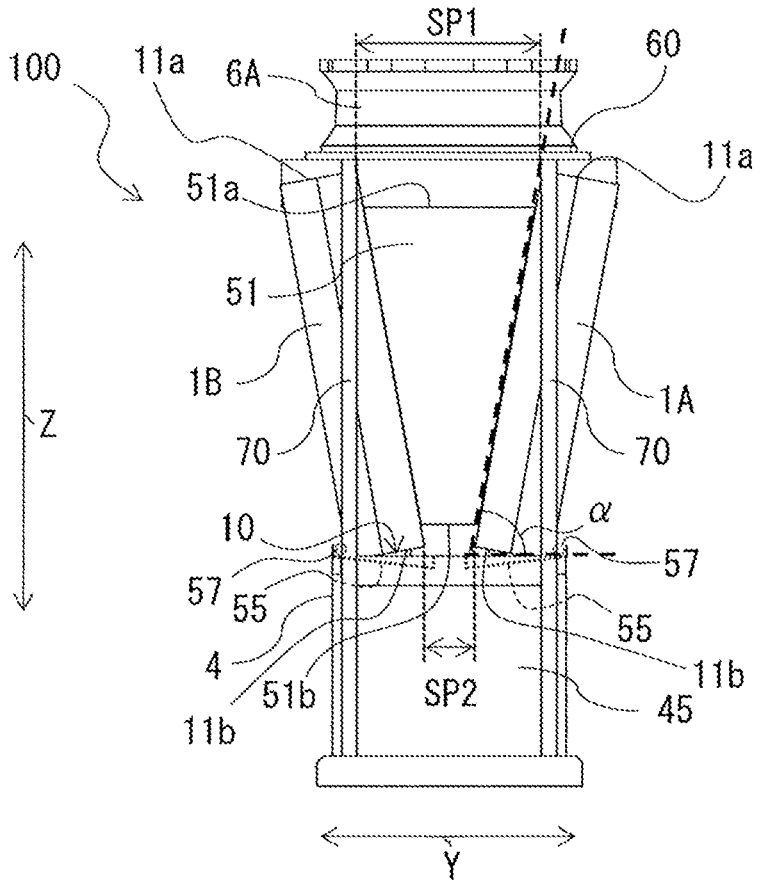
FIG. 3 is a front view of the chilling unit according to Embodiment 1.

FIG. 1 is a perspective view of the chilling unit 100 according to Embodiment 1. FIG. 2 is a side view of the chilling unit 100 according to Embodiment 1. FIG. 3 is a front view of the chilling unit 100 according to Embodiment 1. It should be noted that FIG. 3 is a front view of the chilling unit 100 as seen in a direction indicated by an outlined in FIG. 1. An overview of the chilling unit 100 will be described with reference to FIGS. 1 to 3. In the figures including FIG. 1, the X-axis represents a longitudinal direction of the chilling unit 100, the Y-axis represents a width direction or a lateral direction of the chilling unit 100, and the Z-axis represents a height direction of the chilling unit 100. The positional relationship between individual components (for example, their positional relationship in the height direction) described in the following description is basically a positional relationship between the components that is established when the chilling unit 100 is installed in a usable state.

The chilling unit 100 is used as a heat source apparatus of a chiller. The chilling unit 100 is supplied with a heat transfer fluid, such as water or antifreeze, from a load-side unit (not illustrated). The heat transfer fluid is cooled or heated in the chilling unit 100 and then supplied to the load-side unit. The chilling unit 100 causes the heat transfer fluid to circulate as described above, thereby supplying cooling energy or heating energy to the load-side unit.

The chilling unit 100 has an elongated shape. The chilling unit 100 includes an air heat exchanger 1, a fan 5, and a machine room unit 4 that form a heat-source-side refrigeration cycle circuit.

(Air Heat Exchanger 1)

The air heat exchanger 1 causes heat exchange to be performed between outside air and refrigerant that flows in the air heat exchanger 1, and operates as an evaporator or a condenser. The air heat exchanger 1 includes a plurality of heat transfer tubes 7 and a plurality of fins 8. The air heat exchanger 1 is, for example, a parallel-flow heat exchanger, and includes a pair of headers (not illustrated), the heat transfer tubes 7, and the fins 8. The heat transfer tubes 7 are, for example, aluminum flat tubes. The fins 8 are, for example, corrugated fins. The air heat exchanger 1 is not limited to a parallel-flow heat exchanger. The air heat exchanger 1 may be, for example, a fin-and-tube heat exchanger in which fins 8 each formed in the shape of a plate are arranged in parallel, and heat transfer tubes 7 penetrate the fins 8. The air heat exchanger 1 includes four air heat exchangers 1 that are an air heat exchanger 1A, an air heat exchanger 1B, an air heat exchanger 1C, and an air heat exchanger 1D. The air heat exchanger 1A corresponds to a first air heat exchanger the air heat exchanger 1B corresponds to a second air heat exchanger; the air heat exchanger 1C corresponds to a third air heat exchanger; and the air heat exchanger 1D corresponds to a fourth air heat exchanger.

In the lateral direction (Y-axis direction) of the machine room unit 4, the air heat exchanger 1A and the air heat exchanger 1B are provided opposite to each other. The air heat exchanger 1A and the air heat exchanger 1B are provided as a pair of air heat exchangers 1 and inclined such that an upper spacing SP1, which is the spacing between upper end portions 11*a* of the air heat exchangers 1A and 1B that are located far from the machine room unit 4, is greater than a lower spacing SP2, which is the spacing between lower end portions 11*b* of the air heat exchangers 1A and 1B that are located close to the machine room unit 4. That is, the air heat exchangers 1A and 1B are inclined such that the air heat exchangers 1A and 1B are V-shaped as illustrated in FIG. 3 that is a front view, that is, as viewed in a direction toward the front of the chilling unit 100. Similarly, in the lateral direction (Y-axis direction) of the machine room unit 4, the air heat exchanger 1C and the air heat exchanger 1D are provided opposite to each other and inclined such that the air heat exchangers 1C and 1D are V-shaped. In Embodiment 1, the air heat exchanger 1A is inclined at an inclination angle $\alpha$ of, for example, 65 to 80 degrees. Similarly, the air heat exchanger 1B, the air heat exchanger 1C, and the air heat exchanger 1D, as well as the air heat exchanger 1A, are each inclined at an inclination angle of 65 to 80 degrees.

A top frame 60 is provided above the air heat exchanger 1A, the air heat exchanger 1B, the air heat exchanger 1C, and the air heat exchanger 1D. The top frame 60 forms an upper wall of the chilling unit 100. The top frame 60 is fixed to the machine room unit 4 by support posts 70. The support posts 70 are disposed at opposite end portions of the chilling unit 100 in the longitudinal direction (X-axis direction). To be more specific, at each of the end portions of the chilling unit 100 in the longitudinal direction (X-axis direction), two support posts 70 are provided. The two support posts 70 are provided to extend in the vertical direction, and spaced apart from each other in the lateral direction (Y-axis direction). An upper end portion of each of the support posts 70 is fixed to the top frame 60, and a lower end portion of each support post 70 is fixed to the machine room unit 4.

In the lateral direction (Y-axis direction) of the chilling unit 100, a side panel 50 is provided on one side of the chilling unit 100 such that the side panel 50 covers a space between the air heat exchanger 1A and the air heat exchanger 1C. The side panel 50 is a plate-like panel formed in a substantially rectangular shape. The side panel 50 extends in the vertical direction (Z-axis direction) and the longitudinal direction (X-axis direction). The side panel 50 is provided along the inclination of each air heat exchanger 1 described above. In the lateral direction (Y-axis direction) of the chilling unit 100, another side panel 50 is provided on the other side of the chilling unit 100 such that the side panel 50 covers a space between the air heat exchanger 1B and the air heat exchanger 1D.

In the longitudinal direction (X-axis direction) of the chilling unit 100, a side panel 51 is provided on the one side of the chilling unit 100 such that a side panel 51 covers the space between the air heat exchanger 1A and the air heat exchanger 1B. The side panel 51 is a plate-like panel formed in a substantially trapezoidal shape. The side panel 51 is formed such that an upper edge portion 51*a* of the side panel 51 is longer than a lower edge portion 51*b* of the side panel 51. The side panel 51 extends in the vertical direction (Z-axis direction) and the lateral direction (Y-axis direction). The side panel 51 is provided such that in the longitudinal direction (X-axis direction) of the chilling unit 100, the side panel 51 partially covers the end portions of the air heat exchanger 1A and the air heat exchanger 1B. In the longitudinal direction (X-axis direction) of the chilling unit 100, another side panel 51 is also provided on the other side of the chilling unit 100 such that the side panel 51 covers the space between the air heat exchanger 1C and the air heat exchanger 1D. The side panel 51 is provided such that in the longitudinal direction (X-axis direction) of the chilling unit 100, the side panel 51 partially covers the end portions of the air heat exchanger 1C and the air heat exchanger 1D. The shapes and positions of the air heat exchangers 1, which are included in the features of the chilling unit 100 according to Embodiment 1, will be described later.

(Fan 5)

The top frame 60 is provided with the fan 5 described above. The fan 5 produces a flow of air that will pass through each of the air heat exchangers 1 and be discharged from an air outlet 14 of, for example, a bell mouth 6A described later. The fan 5 is an air-sending unit provided with an axial fan. The fan 5 produces a flow of air for efficient heat exchange at each air heat exchanger 1. The fan 5 includes four fans 5 that are a fan 5A, a fan 5B, a fan 5C, and a fan 5D.

At the top frame 60, a bell mouth 6A, a bell mouth 6B, a bell mouth 6C, and a bell mouth 6D are provided. The fan 5A, the fan 5B, the fan 5C, and the fan 5D are provided inward of the bell mouth 6A, the bell mouth 6B, the bell mouth 6C, and the bell mouth 6D, respectively.

In upper end portions of the bell mouth 6A, the bell mouth 6B, the bell mouth 6C, and the bell mouth 6D, respective air outlets 14 are provided. The chilling unit 100 is a "top-flow type" chilling unit in which the blowing side of each fan 5 faces upward. At the air outlets 14 of the bell mouth 6A, the bell mouth 6B, the bell mouth 6C, and the bell mouth 6D, respective fan guards 17 are provided. The fan 5A, the fan 5B, the fan 5C, and the fan 5D are covered by the respective fan guards 17.

Figure 4:
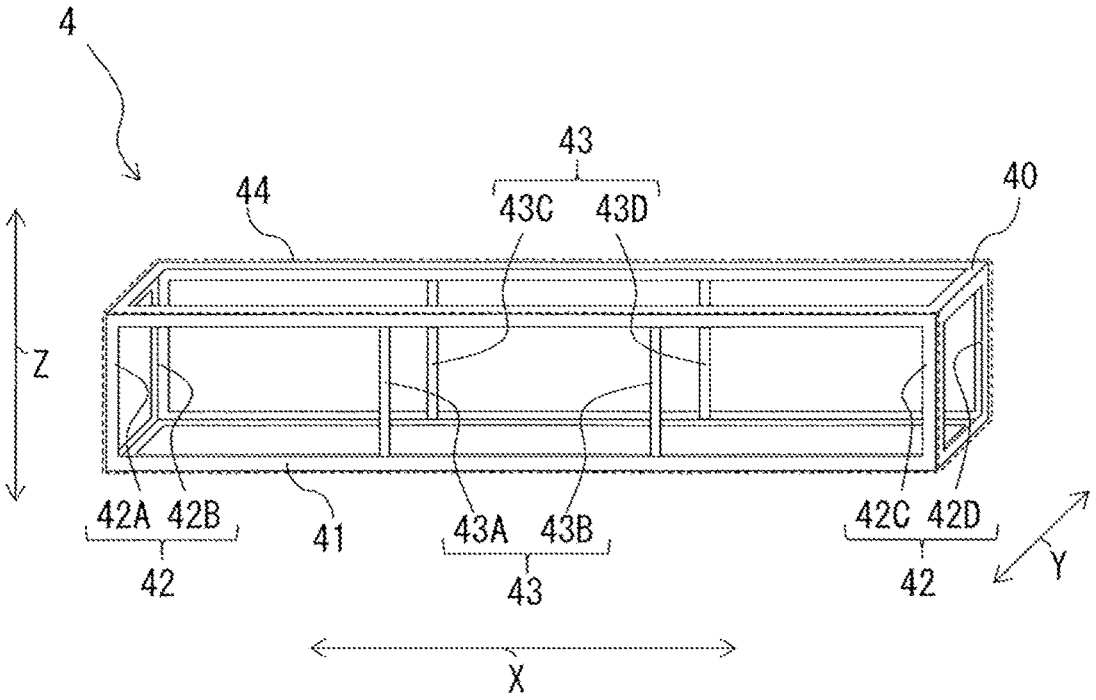
FIG. 4 is a conceptual diagram schematically illustrating a configuration of a machine room unit as illustrated in FIG. 1.

FIG. 4 is a conceptual diagram schematically illustrating a configuration of the machine room unit 4 as illustrated in FIG. 1. In FIGS. 1 and 4, the space occupied by the machine room unit 4 is indicated by dotted lines. The configuration of the machine room unit 4 will be described with reference to FIGS. 1 and 4. The machine room unit 4 is formed in the shape of an elongated box, and is cuboid. The machine room unit 4 includes a cuboid frame 40 and side walls 45 that cover respective spaces between adjacent ones of frame elements included in the frame 40.

The frame 40 includes the following frame elements: an underframe 41, gateposts 42, intermediate posts 43, and a top beam 44. The gateposts 42 include four gateposts 42 that are a gatepost 42A, a gatepost 42B, a gatepost 42C, and a gatepost 42D. The intermediate posts 43 include four intermediate posts 43 that are an intermediate post 43A, an intermediate post 43B, an intermediate post 43C, and an intermediate post 43D. The underframe 41 is rectangular as viewed in plan view, and forms bottom part of the frame 40.

The gatepost 42A, the gatepost 42B, the gatepost 42C, and the gatepost 42D are provided at respective corners of the underframe 41 and extend in a direction orthogonal to the underframe 41. The intermediate post 43A and the intermediate post 43B are provided between the gatepost 42A and the gatepost 42C and spaced from each other in the longitudinal direction (X-axis direction) of the underframe 41. The intermediate post 43C and the intermediate post 43D are provided between the gatepost 42B and the gatepost 42D and spaced from each other in the longitudinal direction (X-axis direction) of the underframe 41. The intermediate post 43A, the intermediate post 43B, the intermediate post 43C, and the intermediate post 43D extend in the direction orthogonal to the underframe 41. The top beams 44 are provided above the gatepost 42A, the gatepost 42B, the gatepost 42C, and the gatepost 42D, as well as the intermediate post 43A, the intermediate post 43B, the intermediate post 43C, and the intermediate post 43D. The above configuration of the frame 40 is described above by way of example. The configuration of the above frame 40 is not limited to the above configuration, and the frame 40 may have any configuration as long as the machine room unit 4 is formed to have a cuboid shape.

A base 10 is provided on the top beam 44 of the machine room unit 4. The base 10 is supported by the gateposts 42 and the intermediate posts 43. The air heat exchanger 1A, the air heat exchanger 1B, the air heat exchanger 1C, and the air heat exchanger 1D as described above are provided on the base 10. That is, the air heat exchangers 1 are provided on the top of the machine room unit 4. Also, a drain pan 55 is provided on the top of the machine room unit 4. The drain pan 55 receives droplets of water discharged from the air heat exchangers 1. The drain pan 55 is provided below the air heat exchangers 1 to receive droplets of water that drips down from the air heat exchangers 1. The drain pan 55 extends in the longitudinal direction (X-axis direction) of the machine room unit 4. The drain pan 55 collects and guides the droplets of water that naturally drips down under gravity from the air heat exchangers 1, as drain water, to a drain outlet (not illustrated).

The side walls 45 includes first side walls 45*a* provided at respective end portions of the machine room unit 4 that are located opposite to each other in the longitudinal direction (X-axis direction) and second side walls 45*b* provided at respective end portions of the machine room unit 4 that are located opposite to each other in the lateral direction (Y-axis direction). The first side walls 45*a* are plate-like side walls that extend in the vertical direction (Z-axis direction) and the lateral direction (Y-axis direction). One of the first side walls 45*a* is located to cover a space located between the gatepost 42A and the gatepost 42B, and the other first side wall 45*a* is located to cover a space located between the gatepost 42C and the gatepost 42D. The second side walls 45*b* are plate-like side walls that extend in the vertical direction (Z-axis direction) and the longitudinal direction (X-axis direction). Of the second side walls 45*b*, second wide walls 45*b* located on one side cover a space located between the gatepost 42A and the intermediate post 43A, a space located between the intermediate post 43A and the intermediate post 43B, and a space located between the intermediate post 43B and the gatepost 42C, and second side walls 45*b* located on the other side cover a space located between the gatepost 42B and the intermediate post 43C, a space located between the intermediate post 43C and the intermediate post 43D, and a space located between the intermediate post 43D and the gatepost 42D.

Figure 5:
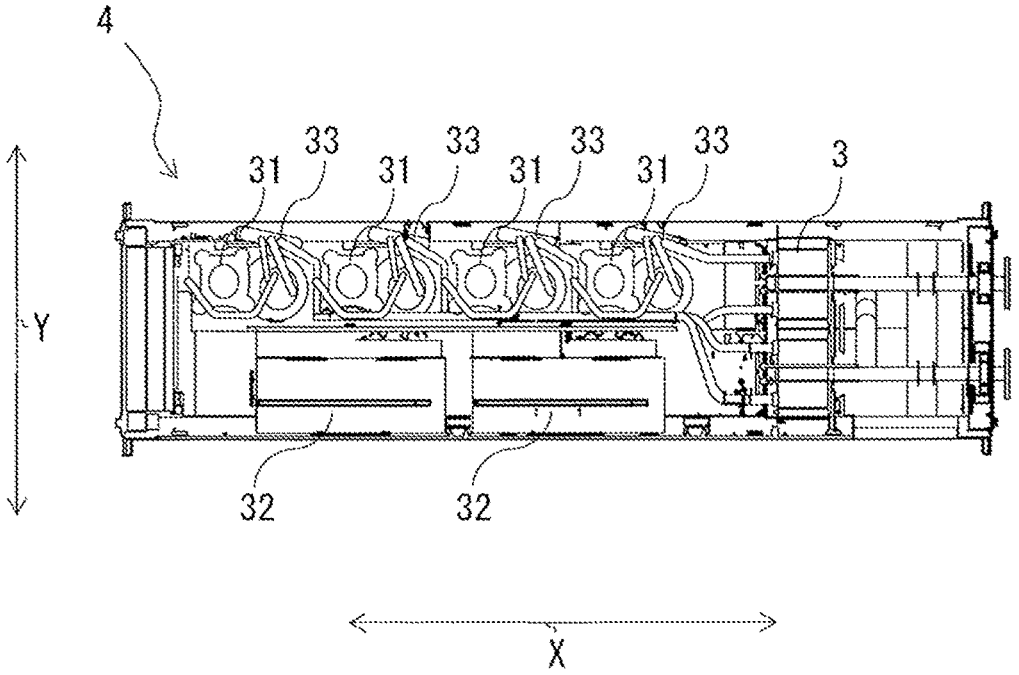
FIG. 5 is a plan view schematically illustrating an internal configuration of the machine room unit as illustrated in FIG. 1.

FIG. 5 is a plan view schematically illustrating an internal configuration of the machine room unit 4 as illustrated in FIG. 1. The machine room unit 4 houses a compressor 31, a flow switching device 33, a heat exchanger 3, and a pressure reducing device (not illustrated). The compressor 31, the flow switching device 33, the heat exchanger 3, the pressure reducing device, and the air heat exchangers 1 are connected in series by refrigerant pipes to form a refrigerant circuit. A plurality of chilling units 100 include respective heat exchangers 3 that are connected in parallel by a water pipe, and a heat transfer fluid in the water pipe is circulated by a pump unit (not illustrated) to flow to a load-side unit (not illustrated) through the heat exchangers 3. A plurality of devices installed in the machine room unit 4 include respective control boxes 32.

The compressor 31 sucks low-temperature and low-pressure refrigerant, compresses the sucked low-temperature and low-pressure refrigerant into high-temperature and high-pressure refrigerant, and discharges the high-temperature and high-pressure refrigerant. The flow switching device 33 is, for example, a four-way valve, and switches, under control by a controller (not illustrated), the flows of refrigerant. The heat exchanger 3 causes heat exchange to be performed between refrigerant and a heat transfer fluid such as water or antifreeze. The pressure reducing device is, for example, an expansion valve, and reduces the pressure of refrigerant. The control box 32 houses, for example, a control board that controls the flow switching device 33, a control board that controls the opening degree of the pressure reducing device or other conditions, an inverter board that controls the rotation speed of the compressor 31 or other conditions, etc.

The machine room unit 4 may include a heater 57. In the case where the chilling unit 100 is operated in a cold area, it may present a question how to handle ice that remains on the drain pan 55. However, in the case where the heater 57 is provided in the chilling unit 100, when the chilling unit 100 is operated in the cold area, the heater 57 can melt ice that forms on the drain pan 55, or prevent icing of drain water. Also, in the case where the machine room unit 4 includes the heater 57, the heater 57 is provided close to one or some the air heat exchangers 1. For example, the heater 57 is provided above the drain pan 55 in such a manner as to extend along the lower end portion 11*b* of one or some of the air heat exchangers 1 in the longitudinal direction (X-axis direction) of the machine room unit 4.

[Shape and Position of Air Heat Exchanger 1]

Figure 6:
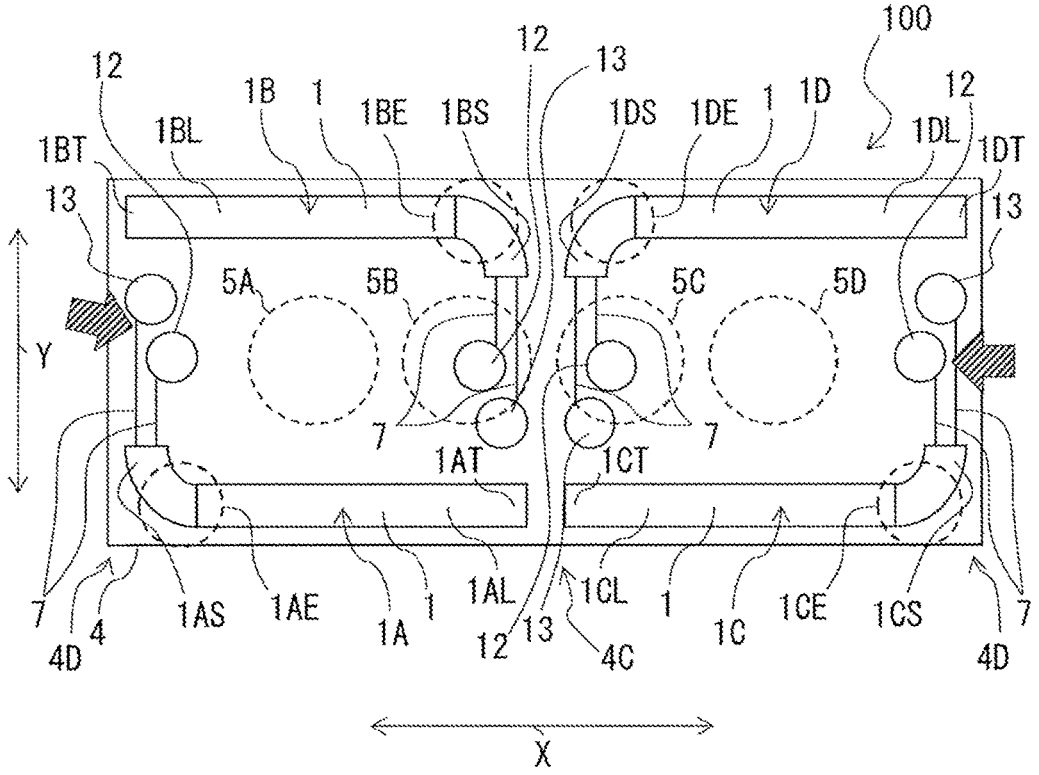
FIG. 6 is a schematic view illustrating the shapes and positions of air heat exchangers in the chilling unit according to Embodiment 1.

FIG. 6 is a schematic view illustrating illustrates the shapes and positions of the air heat exchangers 1 in the chilling unit 100 according to Embodiment 1. FIG. 6 is a top view of the chilling unit 100, and schematically illustrates the shapes and positions of the air heat exchangers 1 as viewed in a direction from the top frame 60 toward the machine room unit 4, with illustration of some components of the chilling unit 100 omitted. Arrows in FIG. 6 indicate directions in which a worker enters the chilling unit 100.

As illustrated in FIG. 6, as viewed in the direction orthogonal to the heat transfer tubes 7, the air heat exchanger 1A, the air heat exchanger 1B, the air heat exchanger 1C, and the air heat exchanger 1D are each bent at 90 degrees at a location between a middle portion and one end portion of each heat transfer tube 7 in the extending direction thereof. That is, the air heat exchanger 1A, the air heat exchanger 1B, the air heat exchanger 1C, and the air heat exchanger 1D are each L-shaped as viewed in the direction from the top frame 60 toward the machine room unit 4.

(Air Heat Exchanger 1A)

The air heat exchanger 1A has a long-side portion 1AL, a corner portion 1AE, and a short-side portion 1AS. The long-side portion 1AL is a portion of the air heat exchanger 1A that is longer than the short-side portion 1AS in flow passages in associated heat transfer tubes 7. A heat-exchanger end portion 1AT is an end portion of the long-side portion 1AL and is also an end portion of the air heat exchanger 1A in the longitudinal direction (X-axis direction) of the machine room unit 4. The corner portion 1AE is an L-shaped portion of the air heat exchanger 1A. The corner portion 1AE is a first corner portion located between the long-side portion 1AL and the short-side portion 1AS. The short-side portion 1AS is a portion of the air heat exchanger 1A that is shorter than the long-side portion 1AL in the direction in which the heat transfer tubes 7 extend.

The above heat transfer tubes 7 protrude from an end portion of the short-side portion 1AS of the air heat exchanger 1A. The heat transfer tubes 7 protruding from the end portion of the short-side portion 1AS do not penetrate the fins 8 and are exposed to the outside. The heat transfer tubes 7 protruding from the end portion of the short-side portion 1AS are linearly formed. Regarding the heat transfer tubes 7 protruding from the end portion of the short-side portion 1AS, an end portion of one of the heat transfer tubes 7 that is an end portion corresponding to the inlet for refrigerant is connected with a header pipe 12, and an end portion of another one of heat transfer tubes 7 that is an end portion corresponding to the outlet for refrigerant is connected with a header pipe 13. One of the header pipe 12 and the header pipe 13 may not be a header pipe but may be a distributor.

(Air Heat Exchanger 1B)

The air heat exchanger 1B has a long-side portion 1BL, a corner portion 1BE, and a short-side portion 1BS. The long-side portion 1BL is a portion of the air heat exchanger 1B that is longer than the short-side portion 1BS in the direction in which associated heat transfer tubes 7 extend. A heat-exchanger end portion 1BT is an end portion of the long-side portion 1BL and is also an end portion of the air heat exchanger 1B in the longitudinal direction (X-axis direction) of the machine room unit 4. The corner portion 1BE is an L-shaped portion of the air heat exchanger 1B. The corner portion 1BE is a second corner portion located between the long-side portion 1BL and the short-side portion 1BS. The short-side portion 1BS is a portion of the air heat exchanger 1B that is shorter than the long-side portion 1BL in the direction in which the heat transfer tubes 7 extend.

The above heat transfer tubes 7 protrude from an end portion of the short-side portion 1BS of the air heat exchanger 1B. The heat transfer tubes 7 protruding from the end portion of the short-side portion 1BS do not penetrate the fins 8 and are exposed to the outside. The heat transfer tubes 7 protruding from the end portion of the short-side portion 1BS are linearly formed. Regarding the heat transfer tubes 7 protruding from an end portion of the short-side portion 1BS, an end portion of one of the heat transfer tubes 7 that is an end portion corresponding to the inlet for refrigerant is connected with the header pipe 12, and an end portion of another one of the heat transfer tubes 7 that is an end portion corresponding to the outlet for refrigerant is connected with the header pipe 13. One of the header pipe 12 and the header pipe 13 may not be a header pipe but may be a distributor.

(Air Heat Exchanger 1C)

The air heat exchanger 1C has a long-side portion 1CL, a corner portion 1CE, and a short-side portion 1CS. The long-side portion 1CL is a portion of the air heat exchanger 1C that is longer than the short-side portion 1CS in the direction in which the heat transfer tubes 7 extend. A heat-exchanger end portion 1CT is an end portion of the long-side portion 1CL and is also an end portion of the air heat exchanger 1C in the longitudinal direction (X-axis direction) of the machine room unit 4. The corner portion 1CE is an L-shaped portion of the air heat exchanger 1C. The corner portion 1CE is a third corner portion located between the long-side portion 1CL and the short-side portion 1CS. The short-side portion 1CS is a portion of the air heat exchanger 1C that is shorter than the long-side portion 1CL in the direction in which the heat transfer tubes 7 extend.

The above heat transfer tubes 7 protrude from an end portion of the short-side portion 1CS of the air heat exchanger 1C. The heat transfer tubes 7 protruding from the end portion of the short-side portion 1CS do not penetrate the fins 8 and are exposed to the outside. The heat transfer tubes 7 protruding from the end portion of the short-side portion 1CS are linearly formed. Regarding the heat transfer tubes 7 protruding from the end portion of the short-side portion 1CS, an end portion of one of the heat transfer tubes 7 that is an end portion corresponding to the inlet for refrigerant is connected with the header pipe 12, and an end portion of another one of the heat transfer tubes 7 that is an end portion corresponding to the outlet for refrigerant is connected with the header pipe 13. One of the header pipe 12 and the header pipe 13 may not be a header pipe but may be a distributor.

(Air Heat Exchanger 1D)

The air heat exchanger 1D has a long-side portion 1DL, a corner portion 1DE, and a short-side portion 1DS. The long-side portion 1DL is a portion of the air heat exchanger 1D that is longer than the short-side portion 1DS in the direction in which the heat transfer tubes 7 extend. A heat-exchanger end portion 1DT is an end portion of the long-side portion 1DL and is also an end portion of the air heat exchanger 1D in the longitudinal direction (X-axis direction) of the machine room unit 4. The corner portion 1DE is an L-shaped portion of the air heat exchanger 1D. The corner portion 1DE is a fourth corner portion located between the long-side portion 1DL and the short-side portion 1DS. The short-side portion 1DS is a portion of the air heat exchanger 1D that is shorter than the long-side portion 1DL in the direction in which the heat transfer tubes 7 extend.

The above heat transfer tubes 7 protrude from an end portion of the short-side portion 1DS of the air heat exchanger 1D. The heat transfer tubes 7 protruding from the end portion of the short-side portion 1DS do not penetrate the fins 8 and are exposed to the outside. The heat transfer tubes 7 protruding from the end portion of the short-side portion 1DS are linearly formed. Regarding the heat transfer tubes 7 protruding from the end portion of the short-side portion 1DS, an end portion of one of the heat transfer tubes 7 that is end portion corresponding to the inlet for refrigerant is connected with the header pipe 12, and an end portion of another one of the heat transfer tubes 7 that is an end portion corresponding to the outlet for refrigerant is connected with the header pipe 13. One of the header pipe 12 and the header pipe 13 may not be a header pipe but may be a distributor.

(Air Heat Exchanger 1A and Air Heat Exchanger 1B)

The air heat exchanger 1A and the air heat exchanger 1B are opposite to each other in the lateral direction (Y-axis direction) of the machine room unit 4. More specifically, in the lateral direction (Y-axis direction) of the machine room unit 4, an end portion of the short-side portion 1AS of the air heat exchanger 1A is opposite to an end portion of the long-side portion 1BL of the air heat exchanger 1B, and an end portion of the short-side portion 1BS of the air heat exchanger 1B is opposite to an end portion of the long-side portion 1AL of the air heat exchanger 1A. The air heat exchanger 1A and the air heat exchanger 1B are arranged symmetrical with respect to a point.

In the longitudinal direction (X-axis direction) of the machine room unit 4, the end portion of the short-side portion 1AS of the air heat exchanger 1A is located close to a unit end portion 4D of the chilling unit 100, and the end portion of the short-side portion 1BS of the air heat exchanger 1B is located close to a middle portion 4C of the chilling unit 100. The header pipe 12 and the header pipe 13 connected to the air heat exchanger 1A are located close to the unit end portion 4D of the chilling unit 100, and the header pipe 12 and the header pipe 13 connected to the air heat exchanger 1B are located close to the middle portion 4C of the chilling unit 100. The longitudinal direction (X-axis direction) of the chilling unit 100 is the same as that of the machine room unit 4. In the longitudinal direction (X-axis direction), the middle portion 4C of the chilling unit 100 is located at the same position as a portion of the machine room unit 4 that is included in the middle portion 4C. Likewise, in the longitudinal direction (X-axis direction), the unit end portion 4D of the chilling unit 100 is located at the same position as a portion of the machine room unit 4 that is included in the unit end portion 4D.

The long-side portion 1AL of the air heat exchanger 1A is parallel to the long-side portion 1BL of the air heat exchanger 1B in the longitudinal direction (X-axis direction) of the machine room unit 4. In the longitudinal direction (X-axis direction) of the machine room unit 4, the heat-exchanger end portion 1AT of the long-side portion 1AL of the air heat exchanger 1A is located close to the middle portion 4C of the chilling unit 100. In the longitudinal direction (X-axis direction) of the machine room unit 4, the heat-exchanger end portion 1BT of the long-side portion 1BL of the air heat exchanger 1B is located close to the unit end portion 4D of the chilling unit 100.

The air heat exchanger 1A and the air heat exchanger 1B are L-shaped and the orientations of the short-side portion 1AS and the long-side portion 1AL of the air heat exchanger 1A are reverse to those of the short-side portion 1BS and the long-side portion 1BL of the air heat exchanger 1B in the longitudinal direction (X-axis direction) of the machine room unit. Accordingly, the air heat exchanger 1A and the air heat exchanger 1B are arranged in the shape of a quadrangle in a horizontal plane. That is, the air heat exchanger 1A and the air heat exchanger 1B, which are a pair of air heat exchangers 1, are arranged in the shape of a quadrangle as viewed in plan view.

(Air Heat Exchanger 1C and Air Heat Exchanger 1D)

The air heat exchanger 1C and the air heat exchanger 1D are opposite to each other in the lateral direction (Y-axis direction) of the machine room unit 4. More specifically, in the lateral direction (Y-axis direction) of the machine room unit 4, the end portion of the short-side portion 1CS of the air heat exchanger 1C is located opposite to the end portion of the long-side portion 1DL of the air heat exchanger 1D, and the end portion of the short-side portion 1DS of the air heat exchanger 1D is located opposite to the end portion of the long-side portion 1CL of the air heat exchanger 1C. The air heat exchanger 1C and the air heat exchanger 1D are arranged symmetrical with respect to a point.

In the longitudinal direction (X-axis direction) of the machine room unit 4, the end portion of the short-side portion 1CS of the air heat exchanger 1C is located close to another unit end portion 4D of the chilling unit 100, and the end portion of the short-side portion 1DS of the air heat exchanger 1D is located close to the middle portion 4C of the chilling unit 100. The header pipe 12 and the header pipe 13 connected to the air heat exchanger 1C are located close to the above unit end portion 4D of the chilling unit 100, and the header pipe 12 and the header pipe 13 connected to the air heat exchanger 1D are located close to the middle portion 4C of the chilling unit 100.

The long-side portion 1CL of the air heat exchanger 1C is parallel to the long-side portion 1DL of the air heat exchanger 1D in the longitudinal direction (X-axis direction) of the machine room unit 4. In the longitudinal direction (X-axis direction) of the machine room unit 4, the heat-exchanger end portion 1CT of the long-side portion 1CL of the air heat exchanger 1C is located close to the middle portion 4C of the chilling unit 100. In the longitudinal direction (X-axis direction) of the machine room unit 4, the heat-exchanger end portion 1DT of the long-side portion 1DL of the air heat exchanger 1D is located close to the unit end portion 4D of the chilling unit 100.

The air heat exchanger 1C and the air heat exchanger 1D are L-shaped and the orientations of the short-side portion 1CS and the long-side portion 1CL of the air heat exchanger 1C are reverse to the short-side portion 1DS and the long-side portion 1DL of the air heat exchanger 1D in the longitudinal direction (X-axis direction) of the machine room unit. Thus, the air heat exchanger 1C and the air heat exchanger 1D are arranged in the shape of a quadrangle in the horizontal plane. That is, the air heat exchanger 1C and the air heat exchanger 1D, which are a pair of air heat exchangers 1, are arranged in the shape of a quadrangle as viewed in plan view.

(Overall Configuration of Air Heat Exchangers 1)

The air heat exchanger 1A and the air heat exchanger 1B, which are a pair of heat exchangers 1, and the air heat exchanger 1C and the air heat exchanger 1D, which are another pair of heat exchangers 1, are arranged symmetrical with respect to the middle portion of the chilling unit 100 in the longitudinal direction (X-axis direction). The air heat exchanger 1A and the air heat exchanger 1C are arranged symmetrical with respect to the middle portion of the chilling unit 100 in the longitudinal direction (X-axis direction). The air heat exchanger 1B and the air heat exchanger 1D are arranged symmetrical with respect to the middle portion of the chilling unit 100 in the longitudinal direction (X-axis direction).

In the air heat exchanger 1B, which is at least one air heat exchanger 1 of a pair of air heat exchangers 1 provided in the lateral direction of the machine room unit 4, the heat-exchanger end portion 1BT of the long-side portion 1BL is located at an end portion of the machine room unit 4 in the longitudinal direction. In the air heat exchanger 1D, which is at least one air heat exchanger 1 of a pair of air heat exchangers 1 provided in the lateral direction of the machine room unit 4, the heat-exchanger end portion 1DT of the long-side portion 1DL is located at another end portion of the machine room unit 4 in the longitudinal direction. The above two pairs of air heat exchangers 1 are arranged side by side in the longitudinal direction (X-axis direction) of the machine room unit 4. That is, the pair of air heat exchangers 1A and 1B and the pair of air heat exchangers 1C and 1D are arranged side by side in the longitudinal direction (X-axis direction) of the machine room unit 4.

In the longitudinal direction of the machine room unit 4, the corner portion 1AE that is the first corner portion is located close to the unit end portion 4D that is one end portion of the machine room unit 4, and the corner portion 1BE that is the second corner portion is located close to the middle portion 4C of the machine room unit 4. The air heat exchanger 1A and the air heat exchanger 1B are arranged in the shape of a quadrangle in the horizontal plane. In the longitudinal direction of the machine room unit 4, the corner portion 1CE that is the third corner portion is located close to the unit end portion 4D that is the other end portion of the machine room unit 4, and the corner portion 1DE that is the fourth corner portion is located close to the middle portion 4C of the machine room unit 4. The air heat exchanger 1C and the air heat exchanger 1D are arranged in the shape of a quadrangle in the horizontal plane. From each of the heat-exchanger end portion 1BT and the heat-exchanger end portion 1DT, heat transfer tubes 7 do not extend. That is, heat transfer tubes 7 that protrude from a fin 8 corresponding to an outermost one of the fins 8 in a direction where the fins 8 are arranged and that extend linearly in the lateral direction (Y-axis direction) do not extend from each of the heat-exchanger end portions 1BT and 1DT.

(Partition Plate 15)

Figure 7:
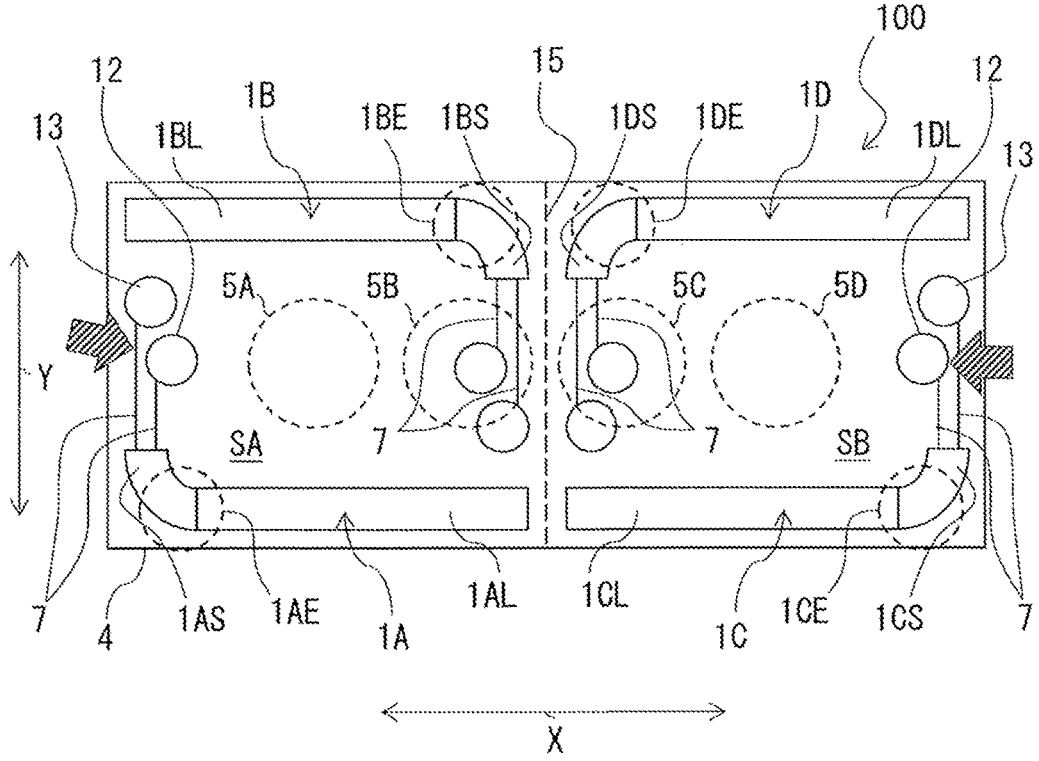
FIG. 7 is a schematic view illustrating a modification of the chilling unit according to Embodiment 1.

FIG. 7 is a schematic view illustrating a modification of the chilling unit 100 according to Embodiment 1. The chilling unit 100 according to the modification includes a partition plate 15. The partition plate 15 forms a wall that isolates the air heat exchangers 1A and 1B from the air heat exchangers 1C and 1D in the longitudinal direction (X-axis direction) of the chilling unit 100. That is, the partition plate 15 is provided between two pairs of air heat exchangers 1 arranged side by side in the longitudinal direction (X-axis direction), and defines a wall. The partition plate 15 is located between the air heat exchangers 1A and 1B and the air heat exchangers 1C and 1D. Also, the partition plate 15 is provided at a center position of each of the machine room unit 4 and the chilling unit 100 in the longitudinal direction (X-axis direction). The "center position" means not only the center position of each of the machine room unit 4 and the chilling unit 100 in the longitudinal direction (X-axis direction) but also a substantially center position close to the center position.

As described above, at one end portion of the chilling unit 100 in the longitudinal direction (X-axis direction), one of the side panels 51 is provided to close the space between the air heat exchanger 1A and the air heat exchanger 1B. Likewise, at the other end portion of the chilling unit 100 in the longitudinal direction (X-axis direction), the other side panel 51 is provided to close the space between the air heat exchanger 1C and the air heat exchanger 1D. Furthermore, one of the side panels 50 is provided to close the space between the air heat exchanger 1A and the air heat exchanger 1C. Likewise, the other side panel 50 is provided to close the space between the air heat exchanger 1B and the air heat exchanger 1D. The partition plate 15 forms a wall that extends between the above side panels 50, that is, the side panel 50 provided between the air heat exchanger 1A and the air heat exchanger 1C and the side panel 50 provided between the air heat exchanger 1B and the air heat exchanger 1D.

In the chilling unit 100 of the modification, a first space SA and a second space SB are divided spaces provided by the partition plate 15. The partition plate 15 isolates the first space SA and the second space SB from each other, and the first space SA being defined by one pair of air heat exchangers 1, the second space SB being defined by the other pair of air heat exchangers 1. To be more specific, the first space SA is defined by the air heat exchanger 1A, the air heat exchanger 1B, the side panel 50, the side panel 51, and the partition plate 15. The second space SB is defined by the air heat exchanger 1C, the air heat exchanger 1D, the side panel 50, the side panel 51, and the partition plate 15. In the chilling unit 100 according to the modification, the first space SA and the second space SB are isolated from each other by the partition plate 15 as described above. As a result, the air heat exchangers 1A and 1B provided as the above one pair and the air heat exchangers 1C and 1D provided as the above other pair can be operated in different operation modes.

[Operation of Chilling Unit 100]

In the chilling unit 100, outside air is caused by the fans 5 to pass through the air heat exchangers 1, whereby the outside air exchanges heat with refrigerant that flows in the air heat exchangers 1. The air that has exchanged heat with the refrigerant is discharged by the fans 5 from the top of the chilling unit 100. In the chilling unit 100, by a switching operation of the flow switching device 33, the operation is switched between a cooling operation in which one or some of the air heat exchangers 1 operate as condensers and the heat exchanger 3 operates as an evaporator and a heating operation in which the air heat exchangers 1 operate as evaporators and the heat exchanger 3 operates as a condenser. In the cooling operation, a heat transfer fluid cooled at the heat exchanger 3 is provided, and for example, the cooled heat transfer fluid is supplied to the load-side unit (not illustrated) to cool air in a load side (indoor side), thereby cooling the indoor space. In the heating operation, a heat transfer fluid heated at the heat exchanger 3 is provided, and for example, the heated heat transfer fluid is supplied to the load-side unit (not illustrated) to heat air in the load side (indoor side), thereby heating the indoor space.

[Advantages of Chilling Unit 100]

In the chilling unit 100, the heat-exchanger end portion 1BT of the long-side portion 1BL of at least one air heat exchanger 1 of a pair of air heat exchangers 1 and the heat-exchanger end portion 1DT of the long-side portion 1DL of at least one air heat exchanger 1 of a pair of air heat exchangers 1 are provided at the respective unit end portions 4D of the machine room unit 4, which are located as the end portions thereof in the longitudinal direction. From each of the heat-exchanger end portion 1BT and the heat-exchanger end portion 1DT, heat transfer tubes 7 do not extend. That is, heat transfer tubes 7 that protrude from a fin 8 corresponding to the outermost one of the fins 8 in a direction where the fins 8 are arranged and that extend linearly in the lateral direction (Y-axis direction) extend from each of the heat-exchanger end portions 1BT and 1DT. Therefore, in the chilling unit 100, the heat transfer tubes 7 at at least one of a pair of air heat exchangers 1 arranged in the lateral direction do not extend to cover the front side of the chilling unit 100. Thus, in the chilling unit 100, not both two systems of header pipes 12 and 13 at a pair of heat exchangers 1 or not both distributors at the pair of air heat exchangers 1 are provided on the front side of the chilling unit where the worker enters the chilling unit. It is therefore possible to provide a sufficient space for the worker to enter the chilling unit 100, on the front side of the chilling unit 100. The worker is thus able to easily enter and exit the space defined by the air exchangers. Accordingly, the ease of maintenance of the chilling unit 100 is improved.

Furthermore, even in the case where heat transfer tubes 7 are provided to extend from the end portions of the long-side portion 1BL and the long-side portion 1DL, in general, the heat transfer tubes 7 are provided to extend to extensions of the long-side portion 1BL and the long-side portion 1DL, and header pipes 12 and 13 are provided at the heat transfer tubes 7. Thus, in the chilling unit 100, not both the two systems of header pipes 12 and 13 at a pair of heat exchangers 1 are provided on the front side of the chilling unit where the worker enters the chilling unit. It is therefore possible to provide a sufficient space for the worker to enter the chilling unit 100, on the front side of the chilling unit 100. The worker is thus able to easily enter and exit the space defined by the air exchangers. Accordingly, the ease of maintenance of the chilling unit 100 is improved.

Figure 8:
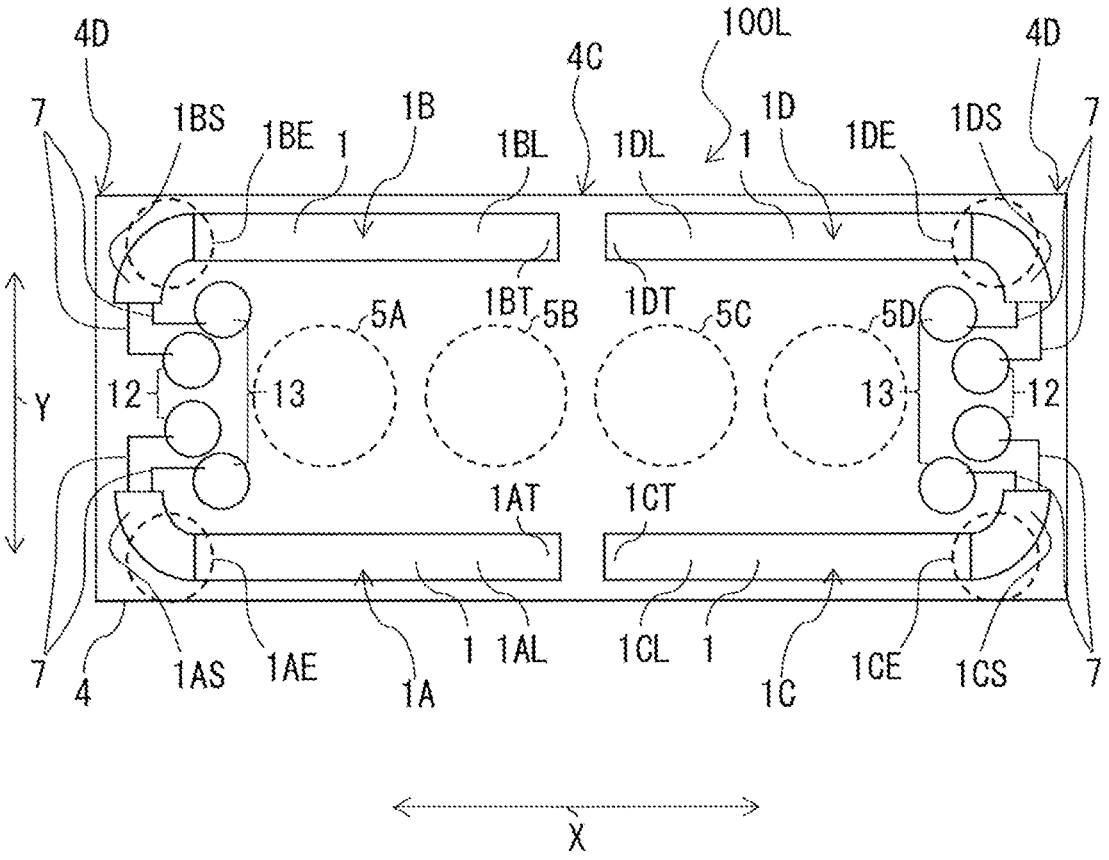
FIG. 8 is a schematic view illustrating the shapes and positions of air heat exchangers in a chilling unit according to a comparative example.

FIG. 8 is a schematic view illustrating the shapes and positions of air heat exchangers 1 in the chilling unit 100L of a comparative example. As illustrated in FIG. 8, as viewed in a direction orthogonal to the heat transfer tubes 7, the air heat exchanger 1A, the air heat exchanger 1B, the air heat exchanger 1C, and the air heat exchanger 1D are each bent at 90 degrees at a location between the middle portion of an associated heat transfer tube 7 and one end portion of the heat transfer tube that is located at an end thereof in the longitudinal direction. That is, the air heat exchanger 1A, the air heat exchanger 1B, the air heat exchanger 1C, and the air heat exchanger 1D are L-shaped. The air heat exchanger 1A and the air heat exchanger 1B are opposite to each other in the lateral direction of the machine room unit 4, and the air heat exchanger 1C and the air heat exchanger 1D are opposite to each other in the lateral direction of the machine room unit 4. The air heat exchanger 1A and the air heat exchanger 1C are arranged side by side in the longitudinal direction of the machine room unit 4, and the air heat exchanger 1B and the air heat exchanger 1D are arranged side by side in the longitudinal direction of the machine room unit 4. Furthermore, the short-side portion 1AS of the air heat exchanger 1A is opposite to the short-side portion 1BS of the air heat exchanger 1B in the lateral direction of the machine room unit 4, and the short-side portion 1CS of the air heat exchanger 1C is opposite to the short-side portion 1DS of the air heat exchanger 1D in the lateral direction of the machine room unit 4. The long-side portion 1AL of the air heat exchanger 1A and the long-side portion 1CL of the air heat exchanger 1C are arranged side by side in the longitudinal direction of the machine room unit 4, and the long-side portion 1BL of the air heat exchanger 1B and the long-side portion 1DL of the air heat exchanger 1D are arranged side by side in the longitudinal direction of the machine room unit 4. Therefore, the air heat exchanger 1A, the air heat exchanger 1B, the air heat exchanger 1C, and the air heat exchanger 1D form a frame that is rectangular as a whole. The corner portion 1AE of the air heat exchanger 1A, the corner portion 1BE of the air heat exchanger 1B, the corner portion 1CE of the air heat exchanger 1C, and the corner portion 1DE of the air heat exchanger 1D, which are corner portions bent at 90 degrees, are located at the corners of the rectangular frame.

In the chilling unit 100L of the comparative example, the end portion of each of the long-side portions of a pair of air heat exchangers 1 is not located at the end portion of the machine room unit 4 in the longitudinal direction. In the chilling unit 100L, the heat transfer tubes 7 of the air heat exchangers 1 each having an L-shaped bent portion in the longitudinal end portion and arranged as a pair of air heat exchangers in the lateral direction extend in such a manner as to cover the front side of the chilling unit 100L. Furthermore, in the chilling unit 100L, two systems of header pipes 12 or distributors of a pair of air heat exchangers 1 are provided on the front side of the chilling unit 100L where the worker enters the chilling unit 100L. Therefore, the worker does not easily enter or exit the space defined by the air heat exchangers 1, and maintenance is not easily performed on the chilling unit 100L.

By contrast, in the chilling unit 100 according to Embodiment 1, the heat-exchanger end portion 1BT of the long-side portion 1BL of at least one of a pair of air heat exchangers 1 and the heat-exchanger end portion 1DT of the long-side portion 1DL of at least one of another pair of heat exchangers 1 re provided at the respective end portions of the machine room unit 4 in the longitudinal direction. It is therefore possible to provide a sufficient space for the worker to enter the chilling unit 100 on the front side of the chilling unit 100. The worker is thus able to easily enter and exit the space defined by the air exchangers. The ease of maintenance of the chilling unit 100 can be improved.

Of two pairs of air heat exchangers 1, one pair of air heat exchangers 1 includes the air heat exchanger 1A having the corner portion 1AE that is the L-shaped first corner portion and the air heat exchanger 1B having the corner portion 1BE that is the L-shaped second corner portion. Of the two pairs of air heat exchangers 1, the other pair of air heat exchangers 1 includes the air heat exchanger 1C having the corner portion 1CE that is the L-shaped third corner portion and the air heat exchanger 1D having the corner portion 1DE that is the L-shaped fourth corner portion. Since all the air heat exchangers 1 each the above configuration have the corner portions such as the corner portion 1AE, it is also possible to increase the area of heat exchange part where heat exchange is performed between air and refrigerant, in the lateral direction (Y-axis direction), and thus to improve the heat exchange performance of the chilling unit 100.

In the longitudinal direction of the machine room unit 4, the corner portion 1AE that is the first corner portion is located close to the unit end portion 4D corresponding to one end portion of the machine room unit 4, and the corner portion 1BE that is the second corner portion is located close to the middle portion 4C of the machine room unit 4. The air heat exchanger 1A and the air heat exchanger 1B are arranged in the shape of a quadrangle in the horizontal plane. In the longitudinal direction of the machine room unit 4, the corner portion 1CE that is the third corner portion is located close to the unit end portion 4D corresponding to the other end portion of the machine room unit 4, and the corner portion 1DE that is the fourth corner portion is located close to the middle portion 4C of the machine room unit 4. The air heat exchanger 1C and the air heat exchanger 1D are arranged in the shape of a quadrangle in the horizontal plane. Thus, in the chilling unit 100, not both the two systems of header pipes 12 and 13 at a pair of heat exchangers 1 are provided on the front side of the chilling unit where the worker enters the chilling unit. It is therefore possible to provide a sufficient space for the worker to enter the chilling unit 100 on the front side of the chilling unit 100. The worker is thus able to easily enter and exit the space defined by the air exchangers. Accordingly, the ease of maintenance of the chilling unit 100 is improved.

The air heat exchangers 1A and 1B provided as one pair and the air heat exchangers 1C and 1D provided as another pair are arranged symmetrical with respect to the middle portion of the chilling unit 100 in the longitudinal direction (X-axis direction). Thus, in the chilling unit 100, not both the two systems of header pipes 12 and 13 at a pair of air heat exchangers 1 are provided on the front side of the chilling unit where the worker enters the chilling unit. It is therefore possible to provide a sufficient space for the worker to enter the chilling unit 100 on the front side of the chilling unit 100. The worker is thus able to easily enter and exit the space defined by the air exchangers. Accordingly, the ease of maintenance of the chilling unit 100 is improved.

In addition, in the chilling unit 100, the first space SA and the second space SB are divided spaces provided by the partition plate 15. As a result, the air heat exchangers 1A and 1B provided as one pair and the air heat exchangers 1C and 1D provided as another pair can be operated in different operation modes. In the chilling unit 100, since the air heat exchangers 1 located in the first space SA and the air heat exchangers 1 located in the second space SB are operated in different operation modes, for example, two systems can individually perform respective defrost operations. Therefore, the chilling unit 100 can reduce a decrease in water temperature, as compared with the case where only the defrost operation can be performed, that is, the systems cannot perform different operations at the same time.

Embodiment 2

[Configuration of Chilling Unit 100A]

Figure 9:
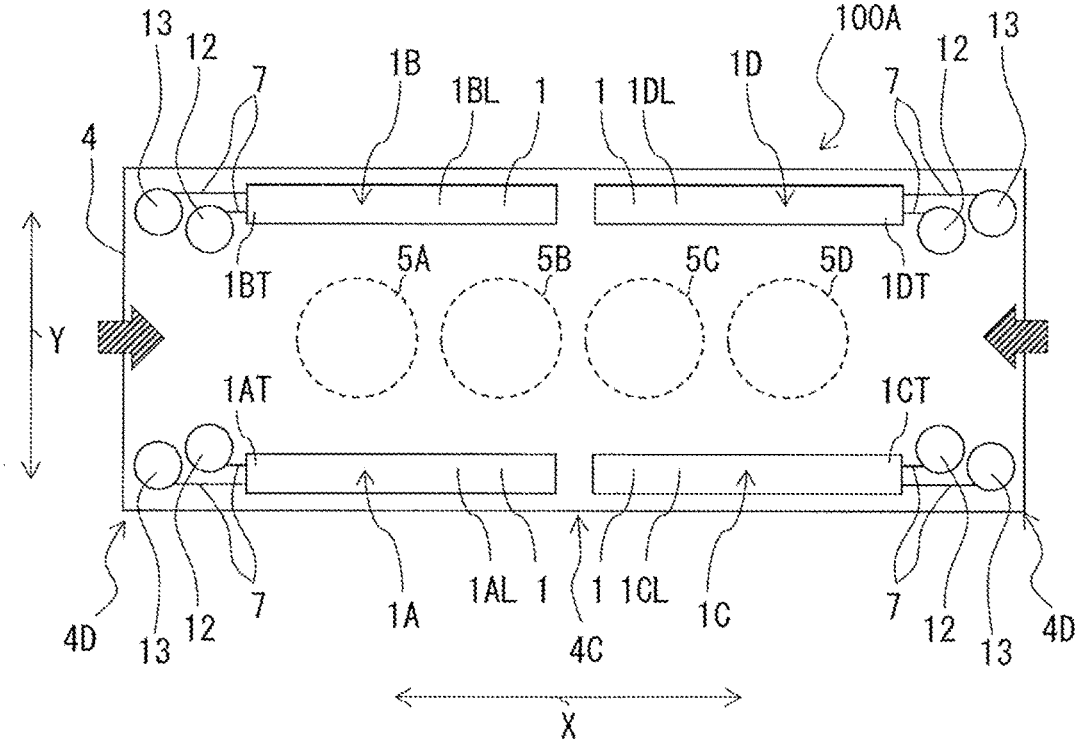
FIG. 9 is a schematic view illustrating the shapes and positions of air heat exchangers in a chilling unit according to Embodiment 2.

FIG. 9 is a schematic view illustrating the shapes and positions of the air heat exchangers 1 in a chilling unit 100A according to Embodiment 2. FIG. 9 is a top view of the chilling unit 100A, with illustration of some components omitted, and schematically illustrates the shapes and positions of the air heat exchangers 1 as viewed in the direction from the top frame 60 toward the machine room unit 4. It should be noted that regarding Embodiment 2, components that are the same as those of the chilling unit 100 as illustrated in FIGS. 1 to 7 are denoted by the same reference signs, and their descriptions will thus be omitted. The chilling unit 100A according to Embodiment 2 differs from the chilling unit 100 according to Embodiment 1 in the shapes and positions of the air heat exchangers 1. The chilling unit 100A will be describe by referring mainly to the differences between the air heat exchangers 1 according to Embodiment 1 and those according to Embodiment 2, and illustration and descriptions of configurations other than configurations related to the differences will be omitted.

As illustrated in FIG. 9, the air heat exchanger 1A, the air heat exchanger 1B, the air heat exchanger 1C, and the air heat exchanger 1D are each formed in the shape of a flat plate. That is, the air heat exchanger 1A, the air heat exchanger 1B, the air heat exchanger 1C, and the air heat exchanger 1D are each I-shaped as viewed in the direction orthogonal to the heat transfer tubes 7.

(Air Heat Exchangers 1A to 1D)

The air heat exchanger 1A has the long-side portion 1AL. The long-side portion 1AL is a portion of the air heat exchanger 1A that is elongated in the direction in which the associated heat transfer tubes 7 extend. The long-side portion 1AL has the heat-exchanger end portion 1AT. The air heat exchanger 1B has the long-side portion 1BL. The long-side portion 1BL is a portion of the air heat exchanger 1B that is elongated in the direction in which the associated heat transfer tubes 7 extend. The long-side portion 1BL has the heat-exchanger end portion 1BT. The air heat exchanger 1C has the long-side portion 1CL. The long-side portion 1CL is a portion of the air heat exchanger 1C that is elongated in the direction in which the associated heat transfer tubes 7 extend. The long-side portion 1CL has the heat-exchanger end portion 1CT. The air heat exchanger 1D has the long-side portion 1DL. The long-side portion 1DL is a portion of the air heat exchanger 1D that is elongated in the direction in which associated heat transfer tubes 7 extend. The long-side portion 1DL has the heat-exchanger end portion 1DT. The air heat exchanger 1A, the air heat exchanger 1B, the air heat exchanger 1C, and the air heat exchanger 1D are each formed such that the associated heat transfer tubes 7 extend in the longitudinal direction (X-axis direction). The air heat exchanger 1A, the air heat exchanger 1B, the air heat exchanger 1C, and the air heat exchanger 1D are each connected with the associated header pipes 12 and 13 at the end portion of each air heat exchanger in the direction in which the associated heat transfer tubes 7 extend.

(Air Heat Exchanger 1A and Air Heat Exchanger 1B)

The air heat exchanger 1A and the air heat exchanger 1B are opposite to each other in the lateral direction (Y-axis direction) of the machine room unit 4. The long-side portion 1AL of the air heat exchanger 1A is parallel to the long-side portion 1BL of the air heat exchanger 1B in the longitudinal direction (X-axis direction) of the machine room unit 4. In the longitudinal direction (X-axis direction) of the machine room unit 4, the heat-exchanger end portion 1AT of the long-side portion 1AL of the air heat exchanger 1A is located close to the associated unit end portion 4D of the chilling unit 100A. In the longitudinal direction (X-axis direction) of the machine room unit 4, one heat-exchanger end portion 1BT of the long-side portion 1BL of the air heat exchanger 1B is located close to the unit end portion 4D of the chilling unit 100A.

(Air Heat Exchanger 1C and Air Heat Exchanger 1D)

The air heat exchanger 1C and the air heat exchanger 1D are opposite to each other in the lateral direction (Y-axis direction) of the machine room unit 4. The long-side portion 1CL of the air heat exchanger 1C is parallel to the long-side portion 1DL of the air heat exchanger 1D in the longitudinal direction (X-axis direction) of the machine room unit 4. In the longitudinal direction (X-axis direction) of the machine room unit 4, one heat-exchanger end portion 1CT of the long-side portion 1CL of the air heat exchanger 1C is located close to the associated unit end portion 4D of the chilling unit 100A. In the longitudinal direction (X-axis direction) of the machine room unit 4, the heat-exchanger end portion 1DT of the long-side portion 1DL of the air heat exchanger 1D is located close to the unit end portion 4D of the chilling unit 100A.

(Overall Configuration of Air Heat Exchangers 1)

The air heat exchangers 1A and 1B provided as one pair and the air heat exchangers 1C and 1D provided as another pair are arranged symmetrical with respect to the middle portion of the chilling unit 100A in the longitudinal direction (X-axis direction). The air heat exchanger 1A and the air heat exchanger 1C are arranged symmetrical the middle portion of the chilling unit 100A in the longitudinal direction (X-axis direction). The air heat exchanger 1B and the air heat exchanger 1D are arranged symmetrical with respect to the middle portion of the chilling unit 100A in the longitudinal direction (X-axis direction).

In a pair of air heat exchangers 1 arranged in the lateral direction (Y-axis direction) of the machine room unit 4, the heat-exchanger end portion 1AT of the long-side portion 1AL is located close to the associated unit end portion 4D of the machine room unit 4 in the longitudinal direction (X-axis direction). In the pair of air heat exchangers 1 arranged in the lateral direction of the machine room unit 4, the heat-exchanger end portion 1BT of the long-side portion 1BL is located close to the unit end portion 4D of the machine room unit 4 in the longitudinal direction (X-axis direction). In another pair of air heat exchangers 1 arranged in the lateral direction of the machine room unit 4, the heat-exchanger end portion 1CT of the long-side portion 1CL is provided close to the associated unit end portion 4D of the machine room unit 4 in the longitudinal direction (X-axis direction). In the other pair of air heat exchangers 1 arranged in the lateral direction of the machine room unit 4, the heat-exchanger end portion 1DT of the long-side portion 1DL is located close to the unit end portion 4D of the machine room unit 4 in the longitudinal direction (X-axis direction).

Figure 10:
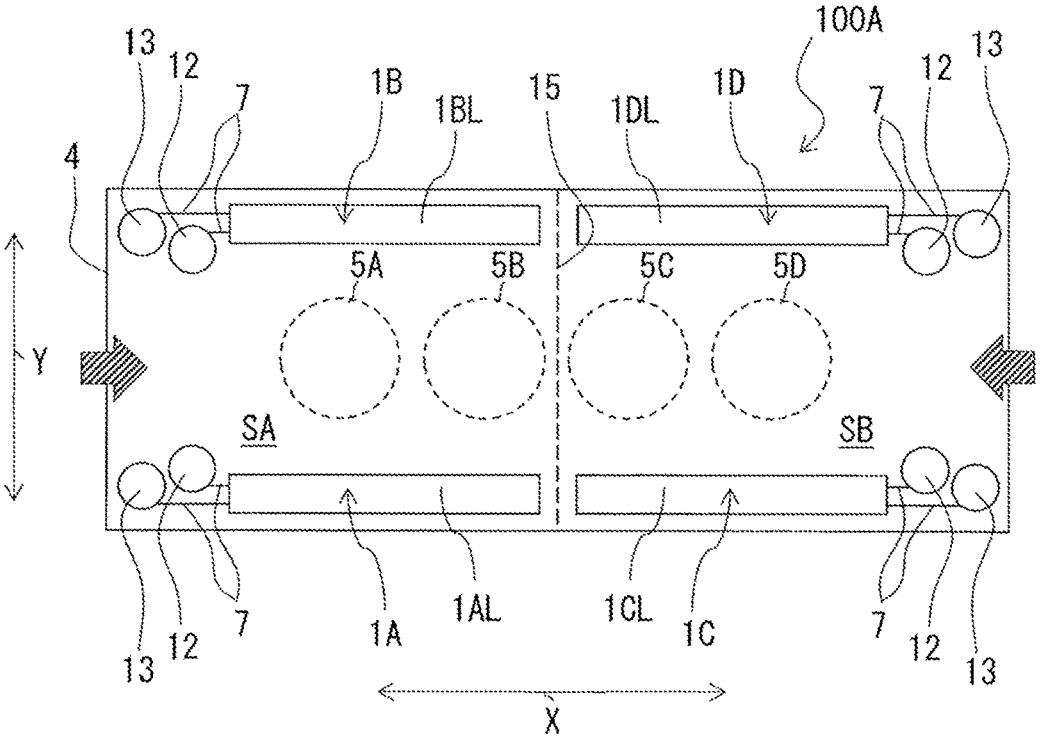
FIG. 10 is a schematic view illustrating a modification of the chilling unit according to Embodiment 2.

FIG. 10 is a schematic view illustrating a modification of the chilling unit 100A according to Embodiment 2. The chilling unit 100A according to the modification includes the partition plate 15.

[Advantages of Chilling Unit 100A]

Of two pairs of air heat exchangers 1, one pair of air heat exchangers 1 includes the air heat exchanger 1A, which is formed in the shape of a flat plate, and the air heat exchanger 1B, which is parallel to the air heat exchanger 1A in the longitudinal direction and formed in the shape of a flat plate. Of the two pairs of air heat exchangers 1, the other pair of air heat exchangers 1 includes the air heat exchanger 1C, which is formed in the shape of a flat plate, and the air heat exchanger 1D, which is parallel to the air heat exchanger 1C in the longitudinal direction and formed in the shape of a flat plate. Therefore, in the chilling unit 100A, the heat transfer tubes 7 of a pair of air heat exchangers 1 disposed in the lateral direction do not extend in such a manner to cover the front side of the chilling unit 100A. Thus, in the chilling unit 100A, not both the two systems of header pipes 12 and 13 at a pair of heat exchangers 1 or not both the distributors at the pair of air heat exchangers 1 are provided on the front side of the chilling unit where the worker enters the chilling unit. It is therefore possible to provide a sufficient space for the worker to enter the chilling unit 100A on the front side of the chilling unit 100A. The worker is thus able to easily enter and exit the space defined by the air exchangers. Accordingly, the ease of maintenance of the chilling unit 100A is improved. Furthermore, the air heat exchangers 1 on the front side of the chilling unit 100A are not bent in the lateral direction, and thus the space on the front side the chilling unit 100A is not closed by the air heat exchangers 1. It is possible to provide a larger space for the worker to enter the chilling unit 100A, on the front side of the chilling unit 100A. The worker is thus able to easily enter and exit the space defined by the air heat exchangers 1. The ease of maintenance of the chilling unit 100A is improved.

The air heat exchangers 1A and 1B and the air heat exchangers 1C and 1D are arranged symmetrical with respect to the middle portion of the chilling unit 100A in the longitudinal direction (X-axis direction). Thus, in the chilling unit 100A, not both the two systems of header pipes 12 and 13 at a pair of air heat exchangers 1 are provided on the front side of the chilling unit where the worker enters the chilling unit. It is therefore possible to provide a sufficient space for the worker to enter the chilling unit 100A. The worker is thus able to easily enter and exit the space defined by the air exchangers. The ease of maintenance of the chilling unit 100A is improved.

Embodiment 3

[Configuration of Chilling Unit 100B]

Figure 11:
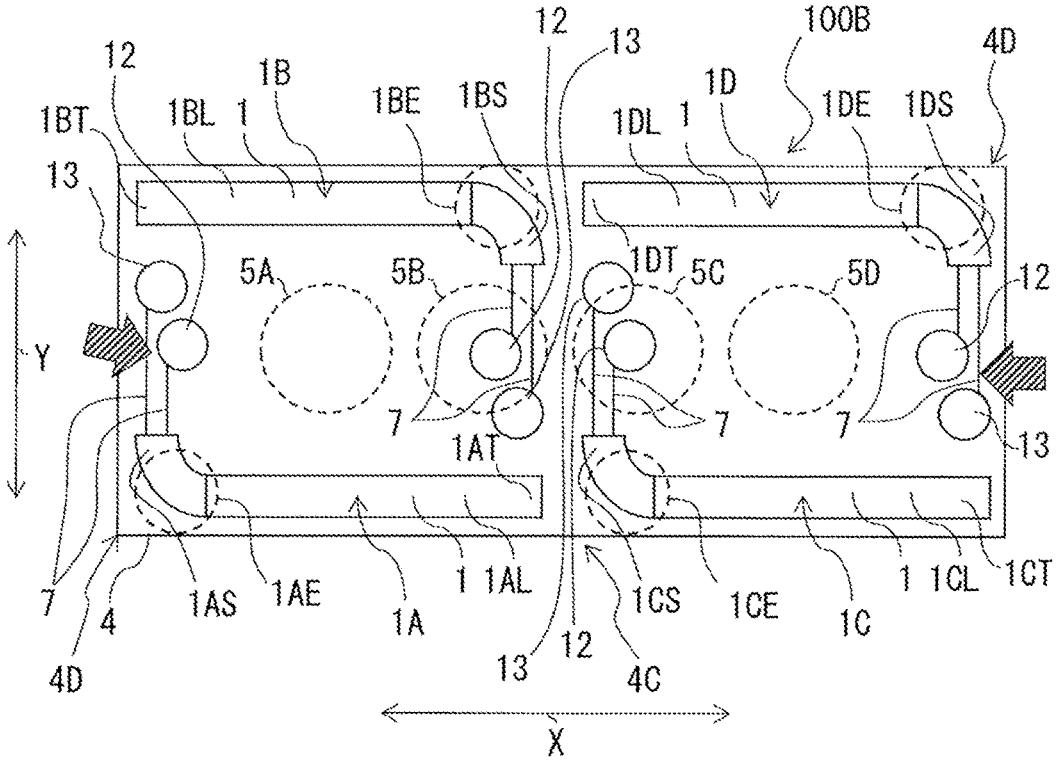
FIG. 11 is a schematic view illustrating the shapes and positions of air heat exchangers in a chilling unit according to Embodiment 3.

FIG. 11 is a schematic view illustrating the shapes and positions of the air heat exchangers 1 in a chilling unit 100B according to Embodiment 3. FIG. 11 is a top view of the chilling unit 100B, and schematically illustrates the shapes and positions of the air heat exchangers 1 as viewed in the direction from the top frame 60 toward the machine room unit 4, with illustration of some components omitted. It should be noted that components that are the same as those of the chilling units 100 as illustrated in FIGS. 1 to 10 are denoted by the same reference signs, and their descriptions will thus be omitted. The chilling unit 100B according to Embodiment 3 differs from the chilling unit 100 according to Embodiment 1 in the shapes and positions of the air heat exchangers 1. The chilling unit 100B will be descried by referring mainly to the differences between the air heat exchangers 1 according to Embodiment 3 and those according to Embodiment 1 and illustration and descriptions of configurations other than configurations related to the differences will be omitted.

As illustrated in FIG. 11, as viewed in the direction orthogonal to the heat transfer tubes 7, the air heat exchanger 1A, the air heat exchanger 1B, the air heat exchanger 1C, and the air heat exchanger 1D are each bent at 90 degrees at a location between the middle portion and one end portion of each of associated heat transfer tubes 7 that is located at an end thereof in the longitudinal direction. That is, the air heat exchanger 1A, the air heat exchanger 1B, the air heat exchanger 1C, and the air heat exchanger 1D are L-shaped as viewed in the direction from the top frame 60 toward the machine room unit 4.

(Air Heat Exchangers 1A to 1D)

The air heat exchanger 1A has the long-side portion 1AL, the corner portion 1AE, and the short-side portion 1AS. The air heat exchanger 1B has the long-side portion 1BL, the corner portion 1BE, and the short-side portion 1BS. The air heat exchanger 1C has the long-side portion 1CL, the corner portion 1CE, and the short-side portion 1CS. The air heat exchanger 1D has the long-side portion 1DL, the corner portion 1DE, and the short-side portion 1DS.

(Air Heat Exchanger 1A and Air Heat Exchanger 1B)

The air heat exchanger 1A and the air heat exchanger 1B are opposite to each other in the lateral direction (Y-axis direction) of the machine room unit 4. More specifically, in the lateral direction (Y-axis direction) of the machine room unit 4, an end portion of the short-side portion 1AS of the air heat exchanger 1A is opposite to an end portion of the long-side portion 1BL of the air heat exchanger 1B, and an end portion of the short-side portion 1BS of the air heat exchanger 1B is opposite to an end portion of the long-side portion 1AL of the air heat exchanger 1A. The air heat exchanger 1A and the air heat exchanger 1B are arranged symmetrical with respect to a point.

In the longitudinal direction (X-axis direction) of the machine room unit 4, an end portion of the short-side portion 1AS of the air heat exchanger 1A is located close to an associated unit end portion 4D of the chilling unit 100B, and an end portion of the short-side portion 1BS of the air heat exchanger 1B is located close to the middle portion 4C of the chilling unit 100B. The header pipes 12 and 13 connected to the air heat exchanger 1A are located close to the unit end portion 4D of the chilling unit 100B, and the header pipes 12 and 13 connected to the air heat exchanger 1B are located close to the middle portion 4C of the chilling unit 100B.

The long-side portion 1AL of the air heat exchanger 1A is parallel to the long-side portion 1BL of the air heat exchanger 1B in the longitudinal direction (X-axis direction) of the machine room unit 4. In the longitudinal direction of the machine room unit 4, the heat-exchanger end portion 1AT of the long-side portion 1AL of the air heat exchanger 1A is located close to the middle portion 4C of the chilling unit 100B. In the longitudinal direction of the machine room unit 4, the heat-exchanger end portion 1BT of the long-side portion 1BL of the air heat exchanger 1B is located close to the unit end portion 4D of the chilling unit 100B.

The air heat exchanger 1A and the air heat exchanger 1B, which are L-shaped, are disposed such that the orientations of the short-side portion 1AS and the long-side portion 1AL of the air heat exchanger 1A are reverse to those of the short-side portion 1BS and the long-side portion 1BL of the air heat exchanger 1B in the longitudinal direction (X-axis direction) of the machine room unit. Accordingly, the air heat exchanger 1A and the air heat exchanger 1B are arranged in the shape of a quadrangle in the horizontal plane. The air heat exchanger 1A and the air heat exchanger 1B, which are provided as a pair of air heat exchangers 1, are arranged in the shape of a quadrangle as viewed in plan view.

(Air Heat Exchanger 1C and Air Heat Exchanger 1D)

The air heat exchanger 1C and the air heat exchanger 1D are opposite to each other in the lateral direction (Y-axis direction) of the machine room unit 4. More specifically, in the lateral direction (Y-axis direction) of the machine room unit 4, the end portion of the short-side portion 1CS of the air heat exchanger 1C is opposite to the end portion of the long-side portion 1DL of the air heat exchanger 1D, and the end portion of the short-side portion 1DS of the air heat exchanger 1D is opposite to the end portion of the long-side portion 1CL of the air heat exchanger 1C. The air heat exchanger 1C and the air heat exchanger 1D are arranged symmetrical with respect to a point.

In the longitudinal direction (X-axis direction) of the machine room unit 4, the end portion of the short-side portion 1CS of the air heat exchanger 1C is located close to the middle portion 4C of the chilling unit 100B, and the end portion of the short-side portion 1DS of the air heat exchanger 1D is located close to an associated unit end portion 4D of the chilling unit 100B. The header pipes 12 and 13 connected to the air heat exchanger 1C are located close to the middle portion 4C of the chilling unit 100B, and the header pipes 12 and 13 connected to the air heat exchanger 1D are located close to the unit end portion 4D of the chilling unit 100B.

The long-side portion 1CL of the air heat exchanger 1C is parallel to the long-side portion 1DL of the air heat exchanger 1D in the longitudinal direction (X-axis direction) of the machine room unit 4. In the longitudinal direction (X-axis direction) of the machine room unit 4, the heat-exchanger end portion 1CT of the long-side portion 1CL of the air heat exchanger 1C is located close to the unit end portion 4D of the chilling unit 100B. In the longitudinal direction (X-axis direction) of the machine room unit 4, the heat-exchanger end portion 1DT of the long-side portion 1DL of the air heat exchanger 1D is located close to the middle portion 4C of the chilling unit 100B.

The air heat exchanger 1C and the air heat exchanger 1D, which are L-shaped, are disposed such that the orientations of the short-side portion 1CS and the long-side portion 1CL of the air heat exchanger 1C are reverse to those of the short-side portion 1DS and the long-side portion 1DL of the air heat exchanger 1D in the longitudinal direction (X-axis direction) of the machine room unit. Therefore, the air heat exchanger 1C and the air heat exchanger 1D are arranged in the shape of a quadrangle in the horizontal plane. The air heat exchanger 1C and the air heat exchanger 1D, which are provided as another pair of air heat exchangers 1, are arranged in the shape of a quadrangle as viewed in plan view.

(Overall Configuration of Air Heat Exchangers 1)

In the chilling unit 100B, the air heat exchangers 1 are arranged symmetrical with respect to a point in shape and position. More specifically, the air heat exchanger 1A and the air heat exchanger 1D are arranged symmetrical with respect to a point. Furthermore, the air heat exchanger 1B and the air heat exchanger 1C are arranged symmetrical with respect to a point. The air heat exchangers 1A and 1B and the air heat exchangers 1C and 1D are arranged to have the same shape and on the opposite sides with respect to the middle position of the chilling unit 100B in the longitudinal direction (X-axis direction).

At least the air heat exchanger 1B, which is at least one air heat exchanger 1 of a pair of air heat exchangers 1 disposed in the lateral direction (Y-axis direction) of the machine room unit 4, has the heat-exchanger end portion 1BT of the long-side portion 1BL at one end portion of the machine room unit 4 in the longitudinal direction. At least the air heat exchanger 1C, which is at least one air heat exchanger 1 of a pair of air heat exchangers 1 disposed in the lateral direction of the machine room unit 4, has the heat-exchanger end portion 1CT of the long-side portion 1CL at another end portion of the machine room unit 4 in the longitudinal direction. Two pairs of air heat exchangers 1 are arranged side by side in the longitudinal direction (X-axis direction) of the machine room unit 4. That is, the air heat exchangers 1A and 1B, which are provided as one pair of air heat exchangers 1, and the air heat exchangers 1C and 1D, which are provided as another pair of air heat exchangers 1, are arranged side by side in the longitudinal direction (X-axis direction) of the machine room unit 4.

In the longitudinal direction of the machine room unit 4, the corner portion 1AE that is the first corner portion is located close to the unit end portion 4D corresponding to the one end portion of the machine room unit 4, and the corner portion 1BE that is the second corner portion is located close to the middle portion 4C of the machine room unit 4. The air heat exchangers 1A and 1B are arranged in the shape of a quadrangle in the cross section. In the longitudinal direction of the machine room unit 4, the corner portion 1CE that is the third corner portion is located close to the middle portion 4C of the machine room unit 4, and the corner portion 1DE that is the fourth corner portion is located close to the unit end portion 4D corresponding to the other end portion of the machine room unit 4. The air heat exchangers 1C and 1D are arranged in the shape of a quadrangle in the cross section. From each of the heat-exchanger end portion 1BT and the heat-exchanger end portion 1CT, heat transfer tubes 7 do not extend. That is, heat transfer tubes 7 that protrude from the fin 8 corresponding to the outermost one of the fin 8 in the direction where the fins 8 are arranged and that extend linearly in the lateral direction (Y-axis direction) do not extend from each of the heat-exchanger end portion 1BT and the heat-exchanger end portion 1CT.

Figure 12:
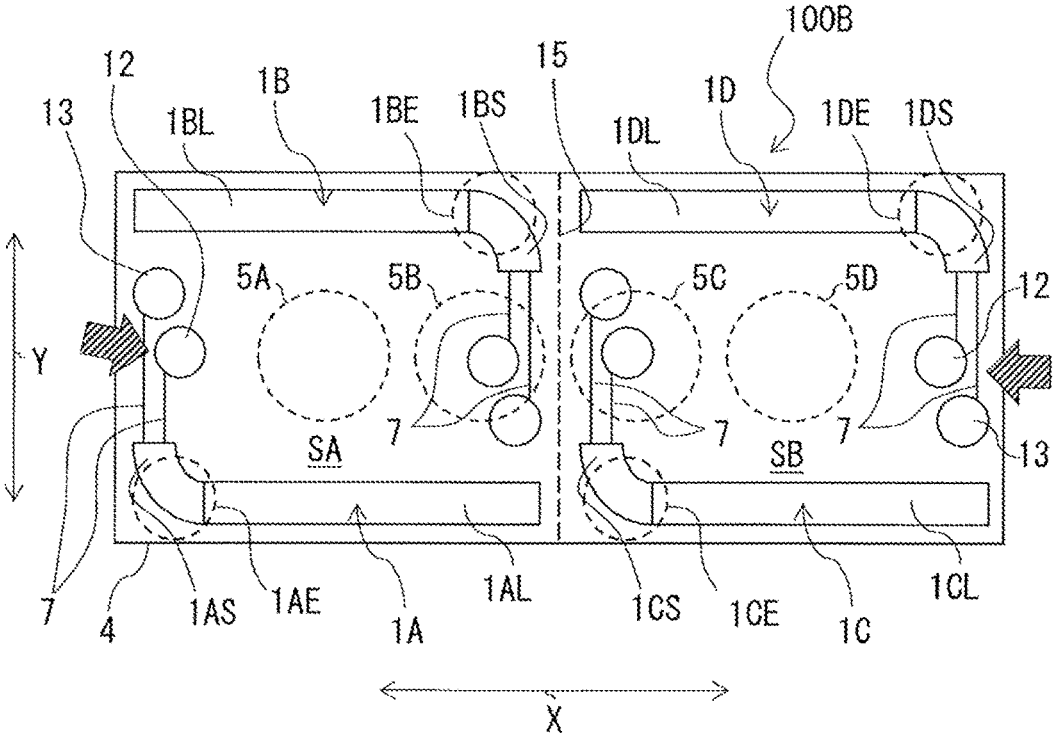
FIG. 12 is a schematic view illustrating a modification of the chilling unit according to Embodiment 3.

FIG. 12 is a schematic view illustrating a modification of the chilling unit 100B according to Embodiment 3. The chilling unit 100B according to the modification includes the partition plate 15.

[Advantages of Chilling Unit 100B]

In the longitudinal direction of the machine room unit 4, the corner portion 1AE that is the first corner portion is provided close to the unit end portion 4D corresponding to the other end portion of the machine room unit 4, and the corner portion 1BE that is the second corner portion is provided close to the middle portion 4C of the machine room unit 4. The air heat exchanger 1A and the air heat exchanger 1B are arranged in the shape of a quadrangle in the horizontal plane. In the longitudinal direction of the machine room unit 4, the corner portion 1CE that is the third corner portion is provided close to the middle portion 4C of the machine room unit 4, and the corner portion 1DE that is the fourth corner portion is provided close to the unit end portion 4D corresponding to the other end portion of the machine room unit 4. The air heat exchanger 1C and the air heat exchanger 1D are arranged in the shape of a quadrangle in the horizontal plane. Thus, in the chilling unit 100B, not both the two systems of header pipes 12 and 13 at a pair of air heat exchangers 1 are provided on the front side of the chilling unit where the worker enters the chilling unit. It is therefore possible to provide a sufficient space for the worker to enter the chilling unit 100B on the front side of the chilling unit 100B. The worker is thus able to easily enter and exit the space defined by the air exchangers. The ease of maintenance of the chilling unit 100B is improved.

The air heat exchangers 1A and 1B and the air heat exchangers 1C and 1D are arranged in the same manner and on the opposite sides with respect to the middle position of the chilling unit 100B in the longitudinal direction (X-axis direction)

Embodiment 4

[Configuration of Chilling Unit 100C]

Figure 13:
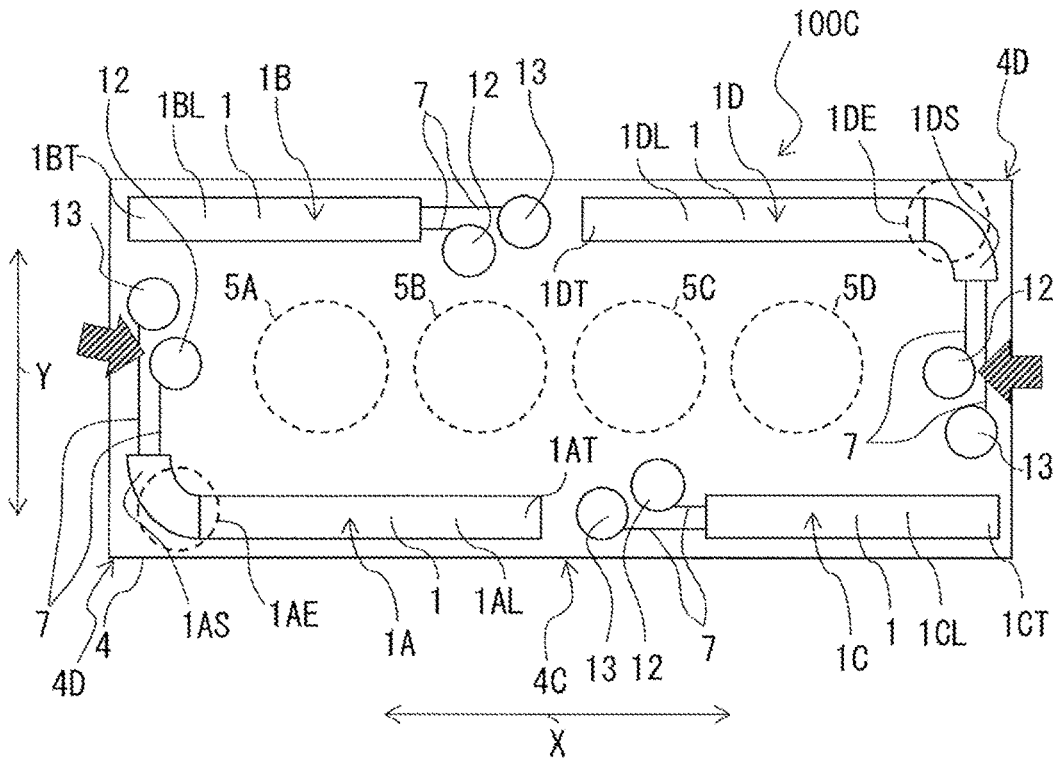
FIG. 13 is a schematic view illustrating the shapes and positions of air heat exchangers in a chilling unit according to Embodiment 4.

FIG. 13 is a schematic view illustrating the shapes and positions of the air heat exchangers 1 in a chilling unit 100C according to Embodiment 4. FIG. 13 is a top view of the chilling unit 100C and schematically illustrates the shapes and positions of the air heat exchangers 1 as viewed in the direction from the top frame 60 toward the machine room unit 4, with illustration of some components omitted. It should be noted that regarding Embodiment 4, components that are the same as those of any of the chilling units 100 as illustrated in FIGS. 1 to 12 are denoted by the same reference signs, and their descriptions will thus be omitted. The chilling unit 100C according to Embodiment 4 differs from the chilling unit 100 according to Embodiment 1 in the shapes and positions of the air heat exchangers 1. The chilling unit 100C will be described by referring mainly to the differences between the air heat exchangers 1 in the chilling unit 100C and those according to Embodiment 1, and illustration and descriptions of configurations other than configurations related to the differences will be omitted.

As illustrated in FIG. 13, as viewed in the direction orthogonal to the heat transfer tubes 7, the air heat exchanger 1A and the air heat exchanger 1D are each bent at 90 degrees at a location between the middle portion and one end portion of each of associated heat transfer tubes 7 in the extending direction thereof. That is, the air heat exchanger 1A and the air heat exchanger 1D are L-shaped as viewed in the direction from the top frame 60 toward the machine room unit 4. The air heat exchanger 1B and the air heat exchanger 1C are each formed in the shape of a flat plate. That is, the air heat exchanger 1B and the air heat exchanger 1C are each I-shaped as viewed in the direction orthogonal to the heat transfer tubes 7.

(Air Heat Exchangers 1A to 1D)

The air heat exchanger 1A has the long-side portion 1AL, the corner portion 1AE, and the short-side portion 1AS. The air heat exchanger 1B has the long-side portion 1BL. The air heat exchanger 1C has the long-side portion 1CL. The air heat exchanger 1D has the long-side portion 1DL, the corner portion 1DE, and the short-side portion 1DS.

(Air Heat Exchanger 1A and Air Heat Exchanger 1B)

The air heat exchanger 1A and the air heat exchanger 1B are opposite to each other in the lateral direction (Y-axis direction) of the machine room unit 4. More specifically, in the lateral direction (Y-axis direction) of the machine room unit 4, the end portion of the short-side portion 1AS of the air heat exchanger 1A is opposite to the end portion of the long-side portion 1BL of the air heat exchanger 1B.

In the longitudinal direction (X-axis direction) of the machine room unit 4, the end portion of the short-side portion 1AS of the air heat exchanger 1A is located close to the unit end portion 4D of the chilling unit 100C. The header pipe 12 and the header pipe 13 connected to the air heat exchanger 1A are located close to one unit end portion 4D of the chilling unit 100C, and the header pipe 12 and the header pipe 13 connected to the air heat exchanger 1B are located close to the middle portion 4C of the chilling unit 100C.

The long-side portion 1AL of the air heat exchanger 1A is parallel to the long-side portion 1BL of the air heat exchanger 1B in the longitudinal direction (X-axis direction) of the machine room unit 4. In the longitudinal direction (X-axis direction) of the machine room unit 4, the heat-exchanger end portion 1AT of the long-side portion 1AL of the air heat exchanger 1A is located close to the middle portion 4C of the chilling unit 100C. In the longitudinal direction (X-axis direction) of the machine room unit 4, the heat-exchanger end portion 1BT of the long-side portion 1BL of the air heat exchanger 1B is located close to the unit end portion 4D of the chilling unit 100C.

(Air Heat Exchanger 1C and Air Heat Exchanger 1D)

The air heat exchanger 1D and the air heat exchanger 1C are opposite to each other in the lateral direction (Y-axis direction) of the machine room unit 4. More specifically, in the lateral direction (Y-axis direction) of the machine room unit 4, the end portion of the short-side portion 1DS of the air heat exchanger 1D is opposite to the end portion of the long-side portion 1CL of the air heat exchanger 1C.

In the longitudinal direction (X-axis direction) of the machine room unit 4, the end portion of the short-side portion 1DS of the air heat exchanger 1D is located close to the unit end portion 4D of the chilling unit 100C. The header pipe 12 and the header pipe 13 connected to the air heat exchanger 1D are located close to the other unit end portion 4D of the chilling unit 100C, and the header pipe 12 and the header pipe 13 connected to the air heat exchanger 1C are located close to the middle portion 4C of the chilling unit 100C.

The long-side portion 1DL of the air heat exchanger 1D is parallel to the long-side portion 1CL of the air heat exchanger 1C in the longitudinal direction (X-axis direction) of the machine room unit 4. In the longitudinal direction (X-axis direction) of the machine room unit 4, the heat-exchanger end portion 1DT of the long-side portion 1DL of the air heat exchanger 1D is located close to the middle portion 4C of the chilling unit 1000. In the longitudinal direction (X-axis direction) of the machine room unit 4, the heat-exchanger end portion 1CT of the long-side portion 1CL of the air heat exchanger 1C is located close to the unit end portion 4D of the chilling unit 100C.

(Overall Configuration of Air Heat Exchangers 1)

Of two pairs of air heat exchangers 1, one pair of air heat exchangers 1 includes the air heat exchanger 1A having the L-shape corner portion 1AE and the air heat exchanger 1B, which is formed in the shape of a flat plate; and the other pair of air heat exchangers 1 includes the air heat exchanger 1C, which is formed in the shape of a flat plate, and the air heat exchanger 1D having the L-shaped corner portion 1DE.

In the chilling unit 1000, the air heat exchangers 1 are arranged symmetrical in shape and position with respect to a point. More specifically, the air heat exchanger 1A and the air heat exchanger 1D are arranged symmetrical with respect to a point. Furthermore, the air heat exchanger 1B and the air heat exchanger 1C are arranged symmetrical with respect to a point.

In at least the air heat exchanger 1B, which is at least one air heat exchanger 1 of a pair of air heat exchangers 1 disposed in the lateral direction (Y-axis direction) of the machine room unit 4, the heat-exchanger end portion 1BT of the long-side portion 1BL is provided at one end portion of the machine room unit 4 in the longitudinal direction. In at least the air heat exchanger 1C, which is at least one air heat exchanger 1 of a pair of air heat exchangers 1 disposed in the lateral direction of the machine room unit 4, the heat-exchanger end portion 1CT of the long-side portion 1CL is provided at the other end portion of the machine room unit 4 in the longitudinal direction. Two pairs of air heat exchangers 1 are arranged side by side in the longitudinal direction (X-axis direction) of the machine room unit 4. That is, the air heat exchangers 1A and 1B provided as one pair and the air heat exchangers 1C and 1D provided as another pair are arranged side by side in the longitudinal direction (X-axis direction) of the machine room unit 4. From each of the heat-exchanger end portion 1BT and the heat-exchanger end portion 1CT, heat transfer tubes 7 do not extend. That is, heat transfer tubes 7 do not extend: the heat transfer tubes 7 that protrude from the fin 8 corresponding to the outermost one of the fins 8 in the direction in which the fins 8 are arranged and that extend linearly in the lateral direction (Y-axis direction) do not extend from each of the heat-exchanger end portion 1BT and the heat-exchanger end portion 1CT.

Figure 14:
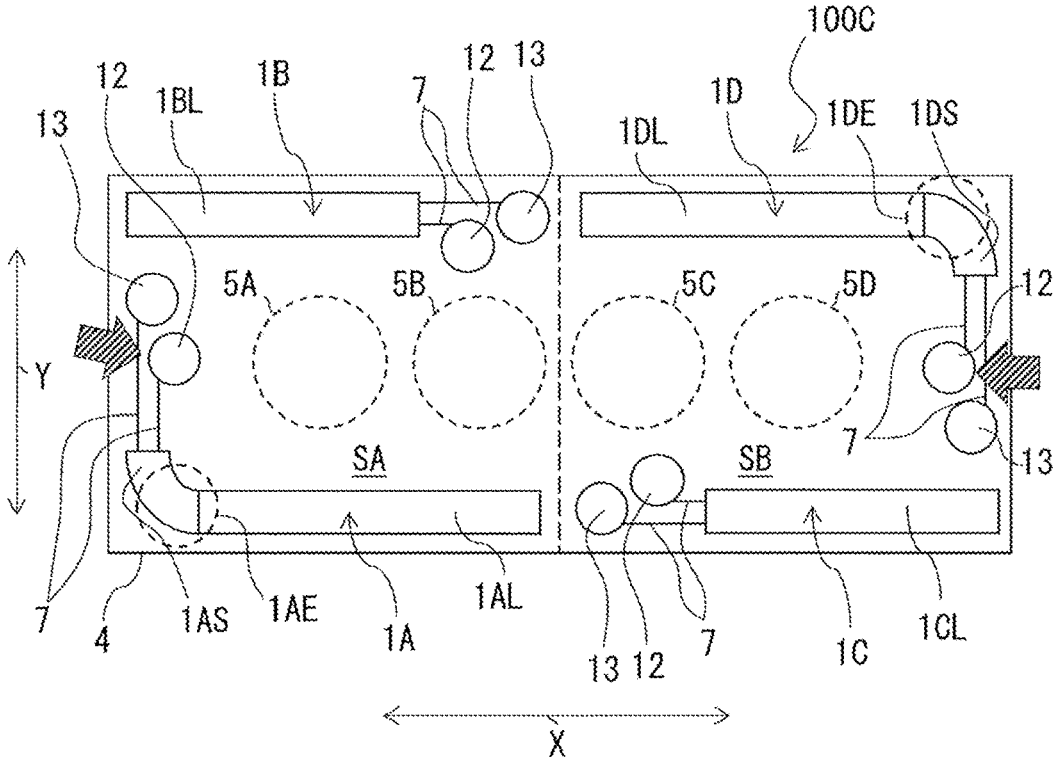
FIG. 14 is a schematic view illustrating a modification of the chilling unit according to Embodiment 4.

FIG. 14 is a schematic view illustrating a modification of the chilling unit 100C according to Embodiment 4. The chilling unit 100C according to the modification includes the partition plate 15.

[Advantages of Chilling Unit 100C]

Of two pairs of air heat exchangers 1, one pair of air heat exchangers 1 includes the air heat exchanger 1A having the L-shaped corner portion 1AE and the air heat exchanger 1B formed in the shape of a flat plate: and the other pair of air heat exchangers 1 includes the air heat exchanger 1C formed in the shape of a flat plate and the air heat exchanger 1D having the L-shaped corner portion 1DE. Thus, in the chilling unit 100C, the heat transfer tubes at one of a pair of air heat exchangers 1 disposed in the lateral direction do not extend in such a manner as to cover the front side of the chilling unit 100C. Therefore, in the chilling unit 100C, not both the two systems of header pipes 12 and 13 or both the distributors at a pair of air heat exchangers 1 are provided on the front side of the chilling unit where the worker enters the chilling unit. It is therefore possible to provide a sufficient space for the worker to enter the chilling unit 100C on the front side of the chilling unit 1000. The worker is thus able to easily enter and exit the space defined by the air exchangers. The ease of maintenance of the chilling unit 100C is improved. Furthermore, on the front side of the chilling unit 100C, the air heat exchanger 1B and the air heat exchanger 1C are not bend in the lateral direction. Thus, the space on the front side the chilling unit 100C is not blocked by the air heat exchanger 1B. It is therefore possible to provide a sufficient space for the worker to enter the chilling unit 100C on the front side of the chilling unit 100C. The worker is thus able to easily enter and exit the space defined by the air heat exchangers 1. The ease of maintenance of the chilling unit 100C can be improved.

Embodiment 5

[Configuration of Chilling Unit 100D]

Figure 15:
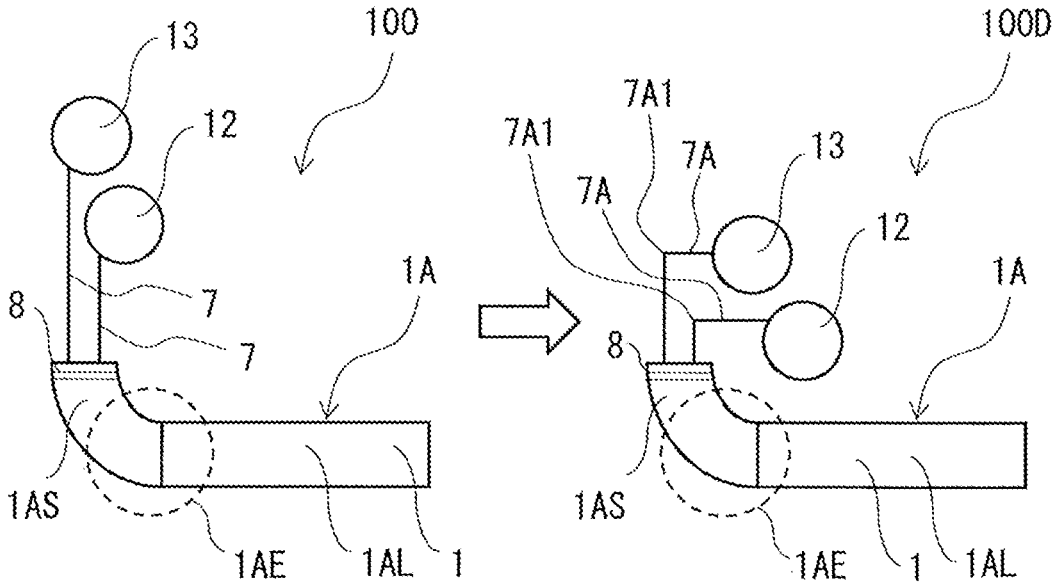
FIG. 15 is an enlarged view of an end portion of an air heat exchanger in a chilling unit according to Embodiment 5.
Figure 16:
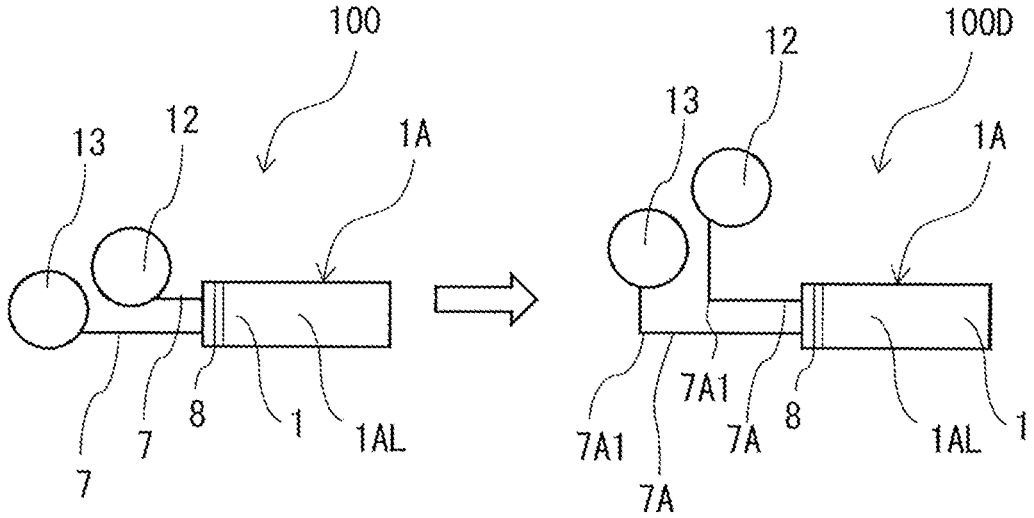
FIG. 16 is an enlarged view of an end portion of another air heat exchanger in the chilling unit according to Embodiment 5.

FIG. 15 is an enlarged view of an end portion of the air heat exchanger 1 in a chilling unit 100D according to Embodiment 5. FIG. 16 is an enlarged view of an end portion of another air heat exchanger 1 in the chilling unit 100D according to Embodiment 5. Each of FIGS. 15 and 16 illustrates an end portion of the air heat exchanger 1 of the chilling unit 100 on the left side of the figure and an end portion of the air heat exchanger 1 of the chilling unit 100D on the right side of the figure. It should be noted that although the air heat exchanger 1A is illustrated as an air heat exchanger 1, the air heat exchanger 1 is not limited to the air heat exchanger 1A but may be the air heat exchanger 1B, the air heat exchanger 1C, or the air heat exchanger 1D. The chilling unit 100 may be the chilling unit 100A, the chilling unit 100B, or the chilling unit 100C. It should be noted that regarding Embodiment 5, components that are the same as those of any of the chilling units 100 as illustrated in FIGS. 1 to 14 will be denoted by the same reference signs and their descriptions will thus omitted.

The chilling unit 100D according to Embodiment 5 includes heat transfer tubes 7A that differ in shape from the heat transfer tubes 7 of the chilling unit 100 according to Embodiment 1. The chilling unit 100D will be described by referring mainly to the differences between the heat transfer tubes 7A and hose according to Embodiment 1, and illustration and descriptions of configurations other than configurations related to the differences will thus be omitted.

Each heat transfer tube 7A has a bent portion 7A1 that is an end portion of the heat transfer tube 7A in the direction in which the heat transfer tube 7A extends and that has a tube passage bent at an exposed portion that does not penetrate the fins 8. It is preferable that the heat transfer tubes 7A be aluminum flat tubes. The bent portion 7A1 is L-shaped, for example, as viewed in plan view. However, the shape of the bent portion 7A1 is not limited to the L-shape.

[Advantages of Chilling Unit 100D]

Each heat transfer tube 7A has the bent portion 7A1, which is an end portion thereof in a direction in which the heat transfer tube 7A and has a tube passage that is bent to the exposed portion that does not penetrate the fins 8. Since each heat transfer tube 7A is bent, it is possible to provide a sufficient space for the worker to enter and exit the chilling unit 100D can be provided on the front side of the chilling unit 100D. The worker is thus able to easily enter and exit the space defined by the air heat exchangers 1, and the ease of the maintenance of the chilling unit 100D is improved. Furthermore, since each heat transfer tube 7A is bent, the air heat exchangers 1 of the chilling unit 100D can be elongated in the longitudinal direction (X-axis direction). It is therefore possible to provide increase the area of the heat exchange portion where heat exchange is performed between air and refrigerant, and improve the heat exchange performance of the chilling unit 100, as compared with the case where the chilling unit 100 does not employ the heat transfer tubes 7A.

The configurations described above with respect to the embodiments are descried merely as examples. These configurations can be each of combined with any of other known techniques, or can be partially omitted or changed without departing from the gist of the present disclosure.

REFERENCE SIGNS LIST

1: air heat exchanger, 1A: air heat exchanger, 1AE: corner portion, 1AL: long-side portion, 1AS: short-side portion, 1AT: heat-exchanger end portion, 1B: air heat exchanger, 1BE: corner portion, 1BL: long-side portion, 1BS: short-side portion, 1BT: heat-exchanger end portion, 1C: air heat exchanger, 1CE: corner portion, 1CL: long-side portion, 1CS: short-side portion, 1CT: heat-exchanger end portion, 1D: air heat exchanger, 1DE: corner portion, 1DL: long-side portion, 1DS: short-side portion, 1DT: heat-exchanger end portion, 3: heat exchanger, 4: machine room unit, 4C: middle portion, 4D: unit end portion, 5: fan, 5A: fan, 5B: fan, 5C: fan, 5D: fan, 6A: bell mouth, 6B: bell mouth, 6C: bell mouth, 6D: bell mouth, 7: heat transfer tube, 7A: heat transfer tube, 7A1: bent portion, 8: fin, 10: base, 11*a*: upper end portion, 11*b*: lower end portion, 12: header pipe, 13: header pipe, 14: air outlet, 15: partition plate, 17: fan guard, 31: compressor, 32: control box, 33: flow switching device, 40: frame, 41: underframe, 42: gatepost, 42A: gatepost, 42B: gatepost, 42C: gatepost, 42D: gatepost, 43: intermediate post, 43A: intermediate post, 43B: intermediate post, 43C: intermediate post, 43D: intermediate post, 44: top beam, 45: side wall, 45*a*: first side wall, 45*b*: second side wall, 50: side panel, 51: side panel, 51*a*: upper edge portion, 51*b*: lower edge portion, 55: drain pan, 57: heater, 60: top frame, 70: support post, 100: chilling unit, 100A: chilling unit, 100B: chilling unit, 100C: chilling unit, 100D: chilling unit, 100L: chilling unit.

The invention claimed is:

1. A chilling unit comprising:

a plurality of air heat exchangers each including a plurality of heat transfer tubes and a plurality of fins; and a machine room unit which is formed in the shape of an elongated box and on which the plurality of air heat exchangers are provided, wherein the plurality of air heat exchangers each have a long-side portion that extends in a longitudinal direction of the machine room unit, each of the plurality of air heat exchangers including a first header pipe and a second header pipe or a distributor in an area close to an end portion of the long-side portion, the first header pipe being connected with an end portion of one of the plurality of heat transfer tubes corresponding to an inlet for refrigerant, the second header pipe or the distributor being connected with an end portion of another one of the plurality of heat transfer tubes corresponding to an outlet for the refrigerant, the plurality of air heat exchangers include two pairs of air heat exchangers, the pairs of air heat exchangers are arranged side by side in the longitudinal direction, and the air heat exchangers of each of the pairs of air heat exchangers are opposite to each other in a lateral direction of the machine room unit, the air heat exchangers of each pair are inclined such that a spacing between upper end portions of the air heat exchangers that are located far from the machine room unit is greater than a spacing between lower end portions of the air heat exchangers that are located close to the machine room unit, and wherein in each pair, the first header pipe and the second header pipe or the distributor of one or both of the air heat exchangers are located at a unit end portion of the machine room unit in the longitudinal direction, and in at least one of the air heat exchangers, at the unit end portion of the machine room unit, heat transfer tubes that protrude from an outermost one of the plurality of fins in a direction in which the plurality of fins are arranged and that extend linearly to the first header pipe and the second header pipe or the distributor in the lateral direction are not provided.

2. The chilling unit of claim 1, wherein of the two pairs of air heat exchangers, one pair of air heat exchangers include a first air heat exchanger having a first corner portion that is L-shaped, and a second air heat exchanger having a second corner portion that is L-shaped, and the other pair of air heat exchangers include a third air heat exchanger having a third corner portion that is L-shaped, and a fourth air heat exchanger having a fourth corner portion that is L-shaped.

3. The chilling unit of claim 2, wherein in the longitudinal direction, the first corner portion is provided close to the unit end portion of the machine room unit, the second corner portion is provided close to a middle portion of the machine room unit, and the first air heat exchanger and the second air heat exchanger are arranged in the shape of a quadrangle in a horizontal plane, and in the longitudinal direction, the third corner portion is provided close to another unit end portion of the machine room unit, the fourth corner portion is provided close to the middle portion of the machine room unit, and the third air heat exchanger and the fourth air heat exchanger are arranged in the shape of a quadrangle in the horizontal plane.

4. The chilling unit of claim 1, wherein of the two pairs of air heat exchangers, one pair of air heat exchangers include a first air heat exchanger formed in the shape of a flat plate, and a second air heat exchanger formed in the shape of a flat plate and located parallel to the first air heat exchanger in the longitudinal direction, and the other pair of air heat exchangers include a third air heat exchanger formed in the shape of a flat plate, and a fourth air heat exchanger formed in the shape of a flat plate and located parallel to the third air heat exchanger in the longitudinal direction.

5. The chilling unit of claim 3, wherein the one pair of air heat exchangers including the first air heat exchanger and the second air heat exchanger and the other pair of air heat exchangers including the third air heat exchanger and the fourth air heat exchanger are arranged symmetrical with respect to a middle portion of the chilling unit in the longitudinal direction.

6. The chilling unit of claim 2, wherein in the longitudinal direction, the first corner portion is located close to the unit end portion of the machine room unit, the second corner portion is located close to a middle portion of the machine room unit, and the first air heat exchanger and the second air heat exchanger are arranged in the shape of a quadrangle in a horizontal plane, and in the longitudinal direction, the third corner portion is provided close to the middle portion of the machine room unit, the fourth corner portion is provided close to another unit end portion of the machine room unit, and the third air heat exchanger and the fourth air heat exchanger are arranged in the shape of a quadrangle in the horizontal plane.

7. The chilling unit of claim 6, wherein the one pair of air heat exchangers including the first air heat exchanger and the second air heat exchanger and the other pair of air heat exchangers including the third air heat exchanger and the fourth air heat exchanger are arranged symmetrical on opposite sides with respect to a center position of the chilling unit in the longitudinal direction.

8. The chilling unit of claim 1, wherein of the two pairs of air heat exchangers, one pair of air heat exchangers include a first air heat exchanger having a corner portion that is L-shaped, and a second air heat exchanger formed in the shape of a flat plate, and the other pair of air heat exchangers include a third air heat exchanger formed in the shape of a flat plate, and a fourth air heat exchanger having a corner portion that is L-shaped.

9. The chilling unit of claim 6, wherein the first air heat exchanger and the fourth air heat exchanger are arranged symmetrical with respect to a point, and the second air heat exchanger and the third air heat exchanger are arranged symmetrical with respect to the point.

10. The chilling unit of claim 1, wherein each of the plurality of heat transfer tubes has a bent portion that corresponds to an end portion of a linearly extending portion of the heat transfer tube, the bent portion being an exposed portion that does not penetrate the plurality of fins included in each of the plurality of air heat exchangers, the bent portion having a tube passage that is bent between the plurality of fins and the first header pipe and the second header pipe or between the plurality of fins and the first header pipe and the distributor.

11. The chilling unit of claim 1, wherein the plurality of heat transfer tubes are aluminum flat tubes.

12. The chilling unit of claim 1, further comprising:

a partition plate that forms a wall located between the two pairs of air heat exchangers arranged side by side in the longitudinal direction, wherein the partition plate isolates a space in which the one pair of air heat exchangers are provided from a space in which the other pair of air heat exchangers are provided.

* * * * *